United States Patent [19]

Adachi et al.

[11] Patent Number: 4,972,753

[45] Date of Patent: Nov. 27, 1990

[54] ELECTRONIC MUSICAL INSTRUMENT

[75] Inventors: Takeshi Adachi; Eiichiro Aoki; Takaaki Muto, all of Hamamatsu, Japan

[73] Assignee: Yamaha Corporation, Hamamatsu, Japan

[21] Appl. No.: 288,079

[22] Filed: Dec. 20, 1988

[30] Foreign Application Priority Data

| | | | |
|---|---|---|---|
| Dec. 21, 1987 | [JP] | Japan | 62-323183 |
| Dec. 25, 1987 | [JP] | Japan | 62-330439 |
| Dec. 25, 1987 | [JP] | Japan | 62-330440 |
| Dec. 25, 1987 | [JP] | Japan | 62-198672 |

[51] Int. Cl.[5] ..... G10H 7/00; G10H 1/02

[52] U.S. Cl. ..... 84/626; 84/437; 84/609; 84/627; 84/658; 84/687

[58] Field of Search ..... 84/1.1, 1.27, DIG. 7, 84/1.19, 1.03, 1.01, DIG. 27, DIG. 12, 1.24, 440, 609–612, 626–627, 634–636, 649–652, 658, 662–663, 666–668, 687, 701–702, 712–714, 439, 440; 341/22, 34

[56] References Cited

U.S. PATENT DOCUMENTS

| | | | |
|---|---|---|---|
| 3,693,775 | 9/1972 | Brooks et al. | 341/34 X |
| 4,195,545 | 4/1980 | Nishimoto | 84/626 |
| 4,528,885 | 7/1985 | Chihana | 84/626 |
| 4,628,785 | 12/1986 | Buchla | 84/1.1 |
| 4,633,750 | 1/1987 | Sakai | 84/626 |
| 4,651,611 | 3/1987 | Deforeit | 84/617 |
| 4,674,382 | 6/1987 | Yorihisa | 84/626 |
| 4,674,384 | 6/1987 | Sakurai | 84/1.03 |
| 4,681,007 | 7/1987 | Nikaido et al. | 84/1.1 |
| 4,700,605 | 10/1987 | Minamitaka | 84/1.24 |
| 4,704,932 | 11/1987 | Mishima | 84/1.03 |
| 4,706,537 | 11/1987 | Oguri | 84/635 X |
| 4,779,505 | 10/1988 | Suzuki | 84/1.1 X |
| 4,875,400 | 10/1989 | Okuda et al. | 84/626 |

*Primary Examiner*—A. T. Grimley
*Assistant Examiner*—Matthew S. Smith
*Attorney, Agent, or Firm*—Spensley Horn Jubas & Lubitz

[57] ABSTRACT

An electronic musical instrument has plural keys each capable of designating different tone pitch and touch response. When any key is depressed by player, touch response information is generated in response to touch intensity or depressing pressure of the depressed key. Based on the touch response information, initial-touch response effect or after-touch response effect is applied to a musical tone of depressed key or musical tones of simultaneously depressed keys. The touch response information is corrected such that the generated musical tones will not be heard un-natural. In addition, by controlling the depressing pressure of key, an automatic performance pattern consisting of predetermined accompaniment pattern and rhythm pattern can be designated and changed.

10 Claims, 22 Drawing Sheets

| KEY | $C_1$ --- $C_3$ --- $B_5$ $B_6$ |
|---|---|
| KEY CODE | 24 --- 48 --- 83 84 |

( RELATION BETWEEN KEY AND KEY CODE )

(MAIN ROUTINE PROCESS)

(AFTER-TOUCH PROCESS)

(MAIN ROUTINE PROCESS)

(AFTER-TOUCH PROCESS)

(TEMPO PROCESS).

(AUTOMATIC PERFORMANCE PATTERN)

(MAIN ROUTINE PROCESS)

(AFTER-TOUCH PROCESS)

(MAIN ROUTINE PROCESS)

(AFTER-TOUCH PROCESS)

( AFTER-TOUCH PROCESS IN POLYPHONIC TONE PERFORMANCE MODE)

ELECTRONIC MUSICAL INSTRUMENT

BACKGROUND OF THE INVENTION

1. Field of the Invention

The present invention relates to an electronic musical instrument, and more particularly to an electronic musical instrument capable of applying touch response effect to each key.

2. Prior Art

Conventionally, the electronic musical instrument as the touch response unit has been proposed in Japanese Patent Laid-Open Publication No. 59-105692. Such proposed electronic musical instrument comprises an initial touch response means and after-touch response means. The initial-touch is the touch response corresponding to the varying speed of depressing pressure at the instant when the key is depressed. The after-touch is the touch response corresponding to the continuous variation of depressing pressure in the period when the key is continuously depressed after the key-depression. The initial touch response means controls tone pitch and tone color which are generated in response to key-depressing speed of depressed key by each key. The after-touch response means controls the tone pitch and tone color of musical tone by each key by varying key-depressing pressure of depressed key.

Such kind of electronic musical instrument is advantageous in that delicate expression of musical tone can be improved, because initial touch effect and after-touch effect can be given to the musical tone by each key.

However, in the case where the above-mentioned touch response unit is applied to so-called electronic musical instrument of complex tone which can simultaneously generate the musical tones having plural tone pitches, each of fingers of player must be moved irregularly so that the effects applied to the musical tones will be heard un-naturally.

For example, in the case where plural keys in accompaniment key area are performed by use of five fingers of player's left hand, all of these fingers can not depress the keys with the same key-depressing pressure in general. Even if all of these five fingers are intended to simultaneously depress the keys with the same key-depressing pressure, the actual key-depressing pressures of the keys must be differed. More specifically, the pressure applied to the key depressed by little finger is the smallest, and other key-depressing pressures of keys tend to become stronger in the order of the third finger, middle finger, forefinger and thumb.

Further, there is an example where the after-touch effect is intended to be simultaneously applied to the keys by use of plural fingers of the player's left hand. In other words, in the state where the chord consisting of tones of "do", "mi" and "so" is generated by use of the player's left hand, the aftertouch effect is applied to each of these three tones. In this case, when the tones of "do", "mi" and "so" are respectively generated by use of the little finger, middle finger and thumb of player's left hand, the key-depressing pressures must be increased in the order of the little finger, middle finger and thumb. Hence, the after-touch effect of the tone "so" having the highest tone pitch is the strongest, that of the tone "mi" having the middle tone pitch is the middle, and that of the tone "do" having the lowest tone pitch is the smallest For this reason, when such chord as a whole must be heard in un-natural manner such that the after-touch response of the higher tone pitch is emphasized.

In general, in the case where the keys are simultaneously performed by use of plural fingers, it is difficult to move the middle-part fingers as similar to the edge-part fingers. Hence, the touch control operation for the middle-part fingers must become un-clear as compared to that for the edge-part fingers.

Meanwhile, in the case where the electronic musical instrument capable of applying the touch response effect to each key is provided with automatic performance means capable of performing with plural performance patterns, the conventional console panel must provide selection switches for exclusively selecting the automatic performance patterns independent of the touch response detecting means of keys. Hence, the constitution of conventional electronic musical instrument must be complicated. In addition, when the player changes over the automatic performance patterns while the keys of the keyboard are performed, the player must temporarily stop performing the keys and then change over the selection switches for the automatic performance patters. This operation is complicated in practice. In addition, since the player must release the keys when the automatic performance pattern is changed, there is a disadvantage in that the generation of musical tones which must be continuously generated is intermittently broken.

SUMMARY OF THE INVENTION

It is accordingly a primary object of the present invention to provide an electronic musical instrument which can avoid the irregularity among the touch response effects applied to plural keys in practice when the touch response effects are simultaneously applied to the keys by use of plural fingers.

It is another object of the present invention to provide an electronic musical instrument which can remarkably simplify the control operation for changing musical tone generating conditions such as the automatic performance patterns.

In a first aspect of the invention, there is provided an electronic musical instrument comprising:

(a) plural keys each designating different tone pitch;

(b) touch response information outputting means for detecting touch intensity of each of depressed keys to thereby output touch response information;

(c) musical tone generating means for generating musical tones corresponding to the depressed keys, each of the musical tones being controlled by the touch response information; and (d) correction means for correcting at least one of the touch response information in response to tone pitch order of the simultaneously depressed keys, whereby touch response effect is applied to each depressed key.

In a second aspect of the invention, there is provided an electronic musical instrument comprising:

(a) a keyboard portion including plural keys each designating different tone pitch;

(b) a central processing unit;

(c) a program memory portion for pre-storing programs representative of main routine process and after-touch process which are executed under control of the central processing unit;

(d) means for detecting depressing pressures of depressed keys, the depressing pressures being converted into after-touch information corresponding to variation of depressing pressure of key after said key is depressed;

(e) a register portion for re-arranging key codes of plural keys which are simultaneously depressed in tone pitch order;

(f) a correction table memory for pre-storing a correction table which stores at least one correction curve representative of relation between actual after-touch information and corrected after-touch information, the after-touch information being corrected so that irregularity among after-touch effects applied to the simultaneously depressed keys due to irregularity among the depressing pressures of the keys each depressed by a different finger of player will be eliminated; and (g) musical tone generating means for generating musical tones to which corrected after-touch effects are applied.

In a third aspect of the invention, there is provided an electronic musical instrument capable of designating tone pitch and also performing touch response operation by depressing a key comprising:

(a) detecting means for detecting touch response information which is obtained based on depressing pressure of key; and (b) means for changing musical tone generating condition when value of the touch response information reaches at the predetermined level.

In a fourth aspect of the invention, there is provided an electronic musical instrument comprising:

(a) plural keys each designating different tone pitch;

(b) touch response information outputting means for detecting touch intensity of depressed key to thereby output corresponding touch response information;

(c) musical tone generating means for generating a musical tone corresponding to the depressed key and controlled by the touch response information; and (d) correction means for detecting number of simultaneously performed keys, the correction means correcting the touch response information in response to the detected number of simultaneously performed keys.

In a fifth aspect of the invention, there is provided an electronic musical instrument comprising:

(a) selecting means for selecting either monophonic tone performance mode capable of simultaneously designating one tone pitch or polyphonic tone performance mode capable of simultaneously designating plural tone pitches;

(b) means for applying touch response effect to a musical tone of depressed key based on touch response information corresponding to depressing pressure of depressed key; and (c) correction means for correcting sensitivity of touch response information such that sensitivity of touch response information in the polyphonic tone performance mode is lowered than that in the monophonic tone performance mode, the touch response effect applied to the musical tone of depressed key being strengthened or weakened based on the sensitivity of touch response information

BRIEF DESCRIPTION OF THE DRAWINGS

Further objects and advantages of the present invention will be apparent from the following description, reference being had to the accompanying drawings wherein preferred embodiments of the present invention are clearly shown.

In the drawings.

DESCRIPTION OF PREFERRED EMBODIMENTS

Figure 1:
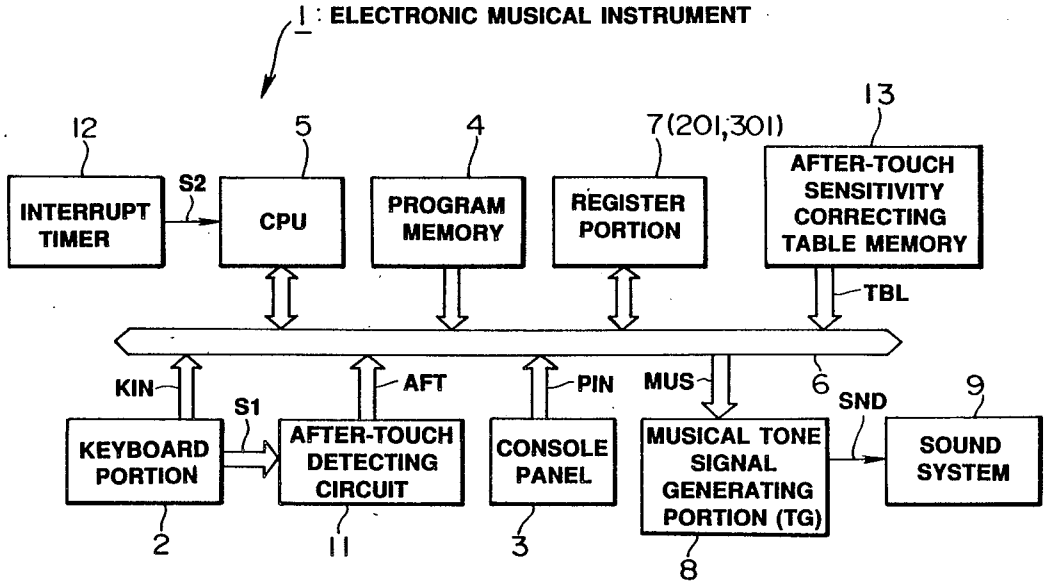
FIG. 1 is a block diagram showing the electronic musical instrument according to a first embodiment of the present invention.

Now, description will be given with respect to the preferred embodiments of the present invention by referring to the drawings wherein like reference characters designate like or corresponding parts throughout the several views.

[A] FIRST EMBODIMENT

This first embodiment is designed to avoid the irregularity among the touch response effects based on the irregularity among the movements of fingers by correcting at least one information within plural number of touch response information each of which is obtained from each key in response to the number of simultaneously depressed keys.

(1) Detailed Description of First Embodiment

Figures 2, 3:
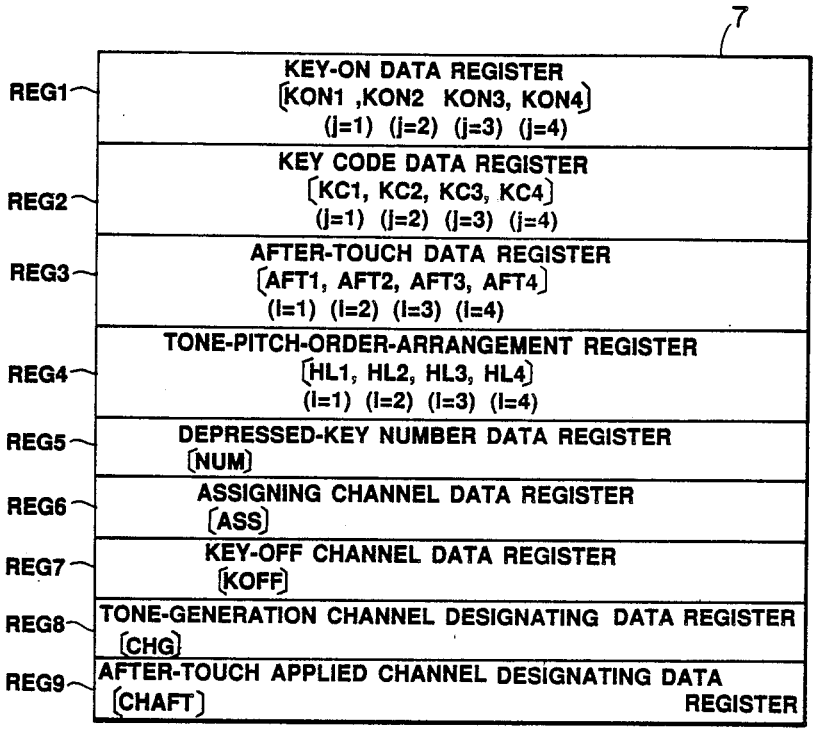
FIG. 2 is a diagrammatical drawing showing a detailed constitution of a register portion of first embodiment shown in FIG. 1.
FIG. 3 shows relationship between keys and key codes.
Figure 4:
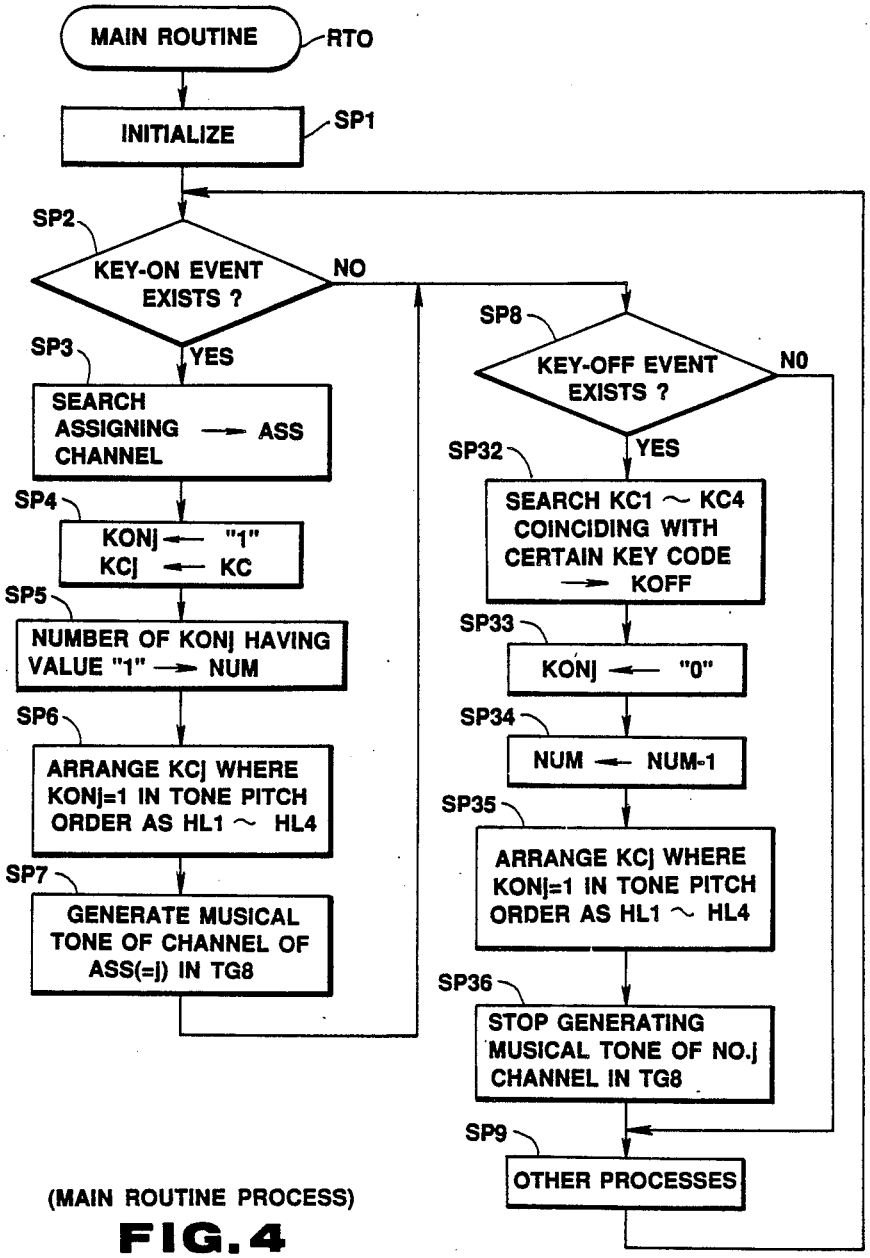
FIGS. 4 and 5 are flowcharts respectively showing a main routine process and after-touch process of a CPU shown in FIG. 1.

In FIG. 1, an electronic musical instrument 1 includes a central processing unit (CPU) 5 which executes a main routine shown in FIG. 4 based on key information KIN inputted from a keyboard portion 2, operable member information PIN inputted from a console panel 3 and program data stored in a program memory 4 constituted by read only memory (ROM), and such information is taken into a register portion 7 (as shown in FIG. 2) constituted by random access memory (RAM) via a bus 6.

In the first embodiment, the electronic musical instrument 1 can simultaneously generate four musical tones When plural keys are simultaneously depressed, the CPU 5 assigns each of plural data corresponding to the depressed keys to one of four tone-generation channels so that the musical tones corresponding to the depressed keys can be simultaneously generated. The CPU 5 supplies musical tone control information MUS corresponding to each depressed key to a musical tone signal generating portion (TG) 8 via the bus 6, so that the TG 8 will generate musical tone signal SND corresponding to the depressed keys. This musical tone signal SND is supplied to a sound system 9, from which the plural musical tones corresponding to the depressed keys can be generated.

In the first embodiment, as shown in FIG. 3, each of key codes 24, ..., 48, ..., 83, 84 is assigned with respect to each of tone pitches $C_1$, ..., $C_3$, ..., $B_5$, $C_6$ respectively corresponding to the sixty one keys.

Each of keys within the keyboard portion 2 is provided with an after-touch sensor consisting of a pressure detecting element, and its detection output Sl is supplied to an after-touch detecting circuit 11 from each key. This after-touch detecting circuit 11 converts the depressing pressure of each key represented by the detection output Sl into after-touch data AFT. The CPU 5 extracts and inputs some after-touch data assigned to the tone-generation channel within the above after-touch data AFT via the bus 6, and then the CPU 5 stores such inputted after-touch data into the register portion 7 by each channel.

Figure 5:
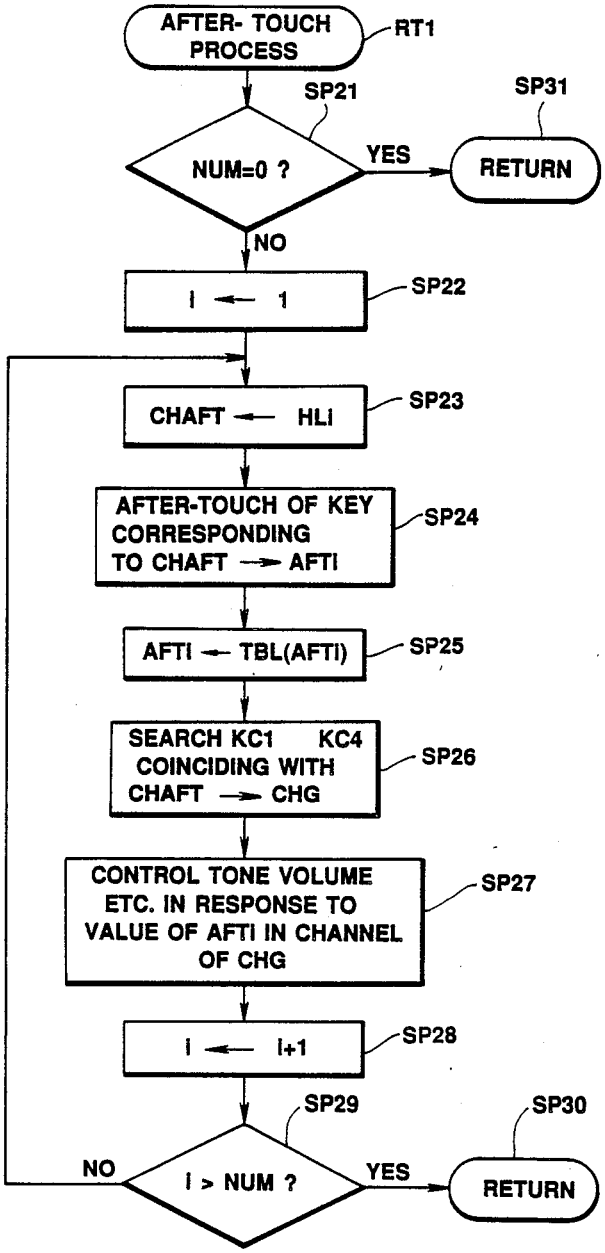
Figure 6A:
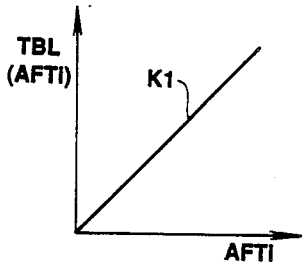
FIGS. 6A to 6D show characteristic curves representative of after-touch sensitivity correcting table data used in the first embodiment.
Figure 6B:
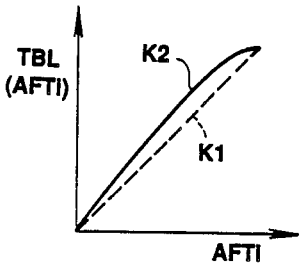
Figure 6C:
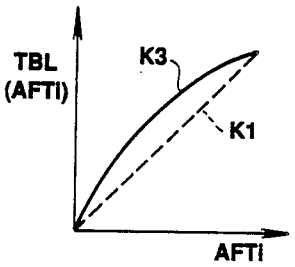
Figure 6D:
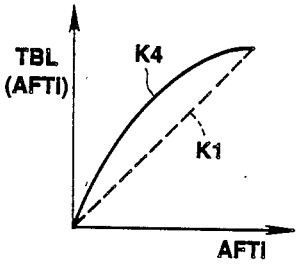

In addition, when an interrupt timer 12 supplies an interrupt signal S2 to the CPU 5 by the predetermined time interval, the CPU 5 executes after-touch processing program RTl shown in FIG. 5 so that the after-touch effect will be applied to the musical tone.

In FIG. 4, when the electronic musical instrument 1 is activated, the CPU 5 starts to execute the main routine RTO, wherein the electronic musical instrument 1 is initialized as a whole in a first step SPl. At this time, each of registers within the register portion 7 is reset.

Next, the processing proceeds to a step SP2 wherein the CPU 5 waits for a key-on event in which the key is newly depressed. If the judgment result of step SP 2 is "YES" (which means that any one of keys is to be newly depressed), the processing proceeds to a step SP3 wherein the CPU 5 searches for vacant channel within four tone-generation channels. At this time, the CPU 5 stores assigning channel data ASS representative of the vacant channel into an assigning channel data register REG6 within the register portion 7.

Herein, the assigning channel data ASS include the data representative of the number j (=1 to 4) of first to fourth tone-generation channels.

Meanwhile, each of key-on data register REGl and key code register REG2 within the register portion 7 has four channels, wherein No.j tone-generation channel is designated by the assigning channel data ASS. Hence, in a next step SP4, the CPU 5 writes key-on data KONj having logical value "1" into the No. j tone-generation channel of the key-on data register REGI, while the CPU 5 writes key code data KCj into the No j tone-generation channel of the key code register REG2. Thus, while the logical value of key-on data KONj is maintained at "1", the register portion 7 holds the data representing that the key corresponding to the written key code data KCj is depressed.

The key-on data register REGl has memory areas corresponding to the first to fourth tone-generation channels (j=1 to 4), and each of these memory areas can be written by corresponding one of key-on data KONl to KON4.

As described above, the CPU 5 executes the processes in the steps SP2, SP3 and SP4, so that the register portion 7 stores the data of depressed key at each time when the player newly depresses the key.

Thereafter, the CPU 5 counts the number of key-on data each having the logical value "1" within KONl to KON4 of the key-on data register REGI in a step SP5, and the counting result is written into a depressed-key number data register REG5 in the register portion 7 as depressed-key number data NUM. Thus, the CPU 5 confirms the number of musical tones which are simultaneously generated at present.

Next, the processing proceeds to a step SP6 wherein the CPU 5 searches the number j of tone-generation channel having logical value "1" based on the key-on data KONl to KON4 Then, the key code data KCj having such number j is read from the key code data register REG2 and arranged in a tone-pitch-order-arrangement register REG4 in the order of higher tone pitch.

Herein, the above register REG4 arranges the key code data KC1 to KC4 of the simultaneously depressed keys at present in such a manner that the key code data having higher tone pitch are arranged ahead of the key code data having lower tone pitch. In addition, each tone-pitch-order number i (=1 to 4) is sequentially assigned to each of the arranged key code data to thereby obtain tone-pitch-order-arrangement key code data HLl to HL4, which are then held in the register portion 7.

The key code data register REG2 holds the key code data KCj corresponding to the channel represented by the assigning channel data ASS of the assigning channel data register REG6. The CPU 5 transfers this key code data KCj to the musical tone signal generating portion 8, from which the corresponding musical tone is to be generated in a step SP7. Thereafter, the processing proceeds to a next step SP8.

On the other hand, when the judgment result of the step SP2 is "NO" (which means that there is no new key-on event), the CPU 5 jumps over the processes of steps SP3 to SP7 and then the processing proceeds to the step SP8.

This step SP8 judges whether the depressed key is newly released or not, i.e., whether key-off event is occurred or not. If the judgment result of this step SP8 is "NO" (which means that there is no new key-off event), the processing proceeds to a step SP9 wherein the CPU 5 executes other processes such as the process for selecting tone color. After executing the other processes in the step SP9, the processing returns to the foregoing step SP2. Thereafter, if there are no key-on event and key-off event occurred, the CPU 5 executes the process for generating the musical tones based on the present performance state of the player by executing the processes in the loop consisting of the steps SP2, SP8 and SP9.

When the interrupt timer 12 supplies the interrupt signal S2 to the CPU 5 in the above state, the CPU 5 executes the after-touch process routine RTI as shown in FIG. 5.

More specifically, the CPU 5 judges whether the depressed-key number data NUM take the decimal value "0" or not in a first step SP21.

When the judgment result of this step SP21 is "NO" (which means that the player depresses one or plural keys), the processing proceeds to a next step SP22 wherein the CPU 5 sets the tone-pitch-order number data i as i=1. Thereafter, the processing proceeds to a next step SP23.

In this step SP23, the CPU 5 reads the tone-pitch-order-arrangement key code data HLl having the tone-pitch-order number data i=1 from the register REG4, and the read key code data HLl are written into an after-touch applied channel designating register REG9 as after-touch applied channel designating data CHAFT. Thereafter, the processing proceeds to a step SP24. In this case, after-touch data AFTi (where i=1) are obtained based on the detection output of after-touch sensor of the key corresponding to the above data CHAFT. Hence, such after-touch data AFTi are inputted into the after-touch data register REG3 in the step SP24.

Within the keys depressed by the player, the highest tone pitch is assigned to certain key. Hence, the above after-touch data AFTl corresponds to the depressing pressure of the finger depressing such certain key when the CPU 5 is interrupted. Thus, the register portion 7 will store the after-touch data which are obtained from the key having the highest tone pitch within the keys depressed by the player.

In such state, the CPU 5 executes after-touch sensitivity correcting process in a next step SP25.

The first embodiment pays attention to the phenomenon in which the depressing pressures by the thumb side fingers are stronger than those by the little finger side fingers in the state where the plural keys are simultaneously depressed when the keys in the accompaniment keyboard portion are played by the player's left hand. The after-touch sensitivity correcting process corrects such phenomenon so that the irregularity which can not be expected by the player is occurred in the after-touch values applied to the musical tones corresponding to all keys. Further, by use of after-touch sensitivity correcting table data (see FIG. 6) which are stored in the program memory 4 in advance, the correcting process is executed on the after-touch sensitivity.

After completing the above correcting process, the CPU 5 searches the key code data KCl to KC4 stored in the key code data register REG2 in a step SP26 so that the CPU 5 will detect the number of channel to which the key code data corresponding to the after-touch applied channel designating data CHAFT are assigned. Then, such detected channel number is written into a tone-generation channel designating register REG8 as tone-generation channel designating data CHG.

This tone-generation channel designating data CHG indicates the tone-generation channel to which the after-touch effect is applied in the steps SP23, SP24 and SP25 described before.

Next, the processing proceeds to a step SP27. As described before, the after-touch data AFTi (where i=1 at this timing) whose after-touch sensitivity is corrected in the step SP25 are rewritten into the after-touch data register REG3. In the step SP27, such rewritten after-touch data are read from the tone-generation channel designated by the above data CHG within the register REG3, and then the read after-touch data are transferred to the corresponding channel of the musical tone signal generating portion 8, whereby the tone volume and tone color etc. of the musical tone are controlled in response to the after-touch data.

Thus, the sound system 9 generates the musical tone to which the after-touch effect is applied based on the after-touch data AFTi whose after-touch sensitivity is corrected.

As described above, the CPU 5 completes the timer interrupt process with respect to the tone-pitch-order number i=1. In a next step SP28, value "1" is added to the tone-pitch-order number i. Thereafter, in a step SP29, the depressed-key number data NUM are read from the depressed-key number data register REG5, and it is judged whether the number i is larger than the value of depressed-key number data NUM or not. If the judgement result of step SP29 is "NO" (which means that the tone-pitch-order number have not coincided with the number of presently depressed keys yet), the processing returns to the step SP23. Thereafter, the after-touch data process in the loop consisting of steps SP23 to SP29 is repeatedly executed with respect to i=2, i=3 and i=4 until the judgment result of step SP29 turns to "YES".

The judgment result "YES" of step SP29 means that the CPU 5 completes the after-touch data process from i=1 to i=NUM.

Thus, the CPU 5 completes all of the processes in the after-touch process routine, and then the processing returns to the main routine from a step SP30.

Incidentally, when the judgment result of step SP21 described before is "YES" (which means that there is no depressed key), the CPU 5 returns to the main routine from a step SP31.

In addition to the above-mentioned processes, the CPU 5 executes the after-touch sensitivity correcting process in the step SP25 by use of the after-touch sensitivity correcting table data as shown in FIG. 6.

More specifically, an after-touch sensitivity correcting table memory 13 (see FIG. 1) stores the data having correction curves Kl, K2, K3 and K4 each shown in FIGS. 6A, 6B, 6C and 6D as the after-touch sensitivity correcting table data when the tone-pitch-order number i is sequentially designated. As this number i incremented, the correction output when the after-touch data AFTi varies must be increased in the correction curves Kl to K4, (which means that the sensitivity for the after-touch operation of the player becomes large).

Thus, it becomes possible to apply the after-touch effects in response to the after-touch sensitivity, wherein the after-touch sensitivities of the little finger side keys (i.e., the keys having lower tone pitch) are set larger than those of the thumb side keys (i.e., the keys having higher tone pitch) when the four keys in the accompaniment keyboard portion are simultaneously depressed by the player's left hand.

Actually, when player simultaneously depresses the plural keys, the depressing pressures of the little finger side keys are weak. However, by correcting such phenomenon, the first embodiment can correct the after-touch effects such that the irregularity among these after-touch effects will not be occurred.

Meanwhile, when the new key-off event is occurred during the key-on event process loop and after-touch process loop are executed, the judgement result of step SP8 turns to "NO" (see FIG. 4). In this case, the CPU 5 starts to execute key-off event process from a step SP32.

More specifically, in the step SP32, the CPU 5 detects the key code coinciding with the key code of the key in which the key-off event is occurred by searching the key code data KCl to KC4 in the key code data register REG2. In this case, key-off channel data KOFF indicate the tone-generation channel number j to which the above coincided key code data are assigned. Then, the CPU 5 writes such key-off channel data KOFF into a key-off channel data register REG7.

In a next step SP33, key-on data KONj corresponds to the tone-generation channel represented by the key-off channel data KOFF, and the CPU 5 varies the logical value of key-on data KONj to "0". Then, the value "1" is subtracted from the depressed-key number data NUM stored in the register REG5 in a step SP34.

In a next step SP35, the key code data KCj corresponds to the tone-generation channel whose key-on data has the logical value "1", and the CPU 5 reads such key code data KCj from the key code data register REG2. Such read key code data KCj are re-arranged in the tone pitch order as the tone-pitch-order-arrangement key code data HLI to HL4 in the register REG4.

Next, the processing proceeds to a step SP36 wherein the CPU 5 stops the tone generation in the tone-generation channel of musical tone signal generating portion 8 where the key-off event is occurred, and then the processing returns to the step SP9.

As described above, when the CPU 5 stops the tone generation of the tone-generation channel to which the key of key-off event is assigned In addition, the CPU 5 re-arranges the key code data which will become the tone-pitch-order-arrangement key code data HLl to HL4 written in the register REG4. Further, the depressed-key number NUM in the register REG 5 is subtracted by "1".

In the first embodiment which comprises and operates as described heretofore, when the player newly depresses the key, the assigning channel data register REG6 stores the assigning channel data ASS representative of the tone-generation channel to which such newly depressed key is to be assigned (in the step SP3). In addition, the key-on data register REGl and key code data register REG2 respectively store the corresponding key-on data KONj and key code data KCj (in the step SP4).

Based on such stored data in the register portion 7, the CPU 5 executes the processes in the steps SP5 to SP7. More specifically, based on the key-on data stored in the register REGl, the register REG5 stores the depressed-key number data NUM representative of the number of presently depressing keys (in the step SP5). Then, the key code data KCl to KC4 of the presently depressing keys are arranged in the tone pitch order in the register REG4 (in the step SP6). In addition, based on the assigning channel data ASS stored in the register REG6, the musical tone of the newly depressed key is generated in the corresponding channel (in the step SP7).

Thus, the sound system 9 generate the musical tones corresponding to the presently depressing keys. When the interrupt timer 12 outputs the interrupt signal S2 in such state, the processing proceeds to the after-touch process routine RTI shown in FIG. 5. More specifically, with respect to the key code data, i.e., the tone-pitch-order-arrangement key code data HLi arranged in the register REG4, the after-touch data AFTi are stored in the register REG3 (in the steps SP23 and SP24) until the tone-pitch-order number i is changed from i=1 (see step SP22) to i=NUM (see step SP29). Thereafter, such stored after-touch data AFTi are corrected based on the after-touch sensitivity correcting table data (see FIG. 6) (in the step SP25).

Therefore, the after-touch data AFTi which are obtained under relatively weak depressing pressures applied to the little finger side keys are corrected with large sensitivity. On the contrary, other after-touch data AFTi which are obtained under relatively strong depressing pressures applied to the thumb side keys are corrected with small sensitivity. As a result, if there is an irregularity among the depressing pressures applied to the plural keys which are simultaneously depressed, the first embodiment can eliminate this irregularity such that the irregularity will not be occurred among the musical tones generated in the sound system 9. Thus, it is possible to generate the musical tones to which the natural after-touch effects are applied.

(2) Modified Examples of First Embodiment (a) In the first embodiment described above, with respect to the after-touch data AFTi, the correction for the after-touch sensitivity of the little finger side keys having lower tone pitches is set larger as compared to the correction for the after-touch sensitivity of the thumb side keys having higher tone pitches. Instead, it is possible to correct the after-touch data as shown in FIG. 7.

Figure 7A:
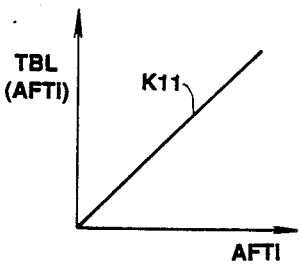
FIGS. 7A and 7B show characteristic curves used in other modified examples of the first embodiment.
Figure 7B:
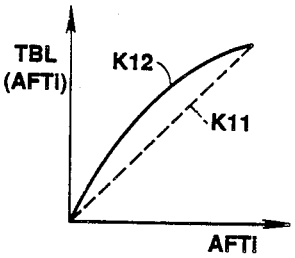

Namely, the after-touch data AFTi are corrected based on a correction curves Kll and K12 shown in FIGS. 7A and 7B. More specifically, the correction for the after-touch data of the outside keys, i.e., the keys of the tone-pitch-order number i=1 and i=NUM within the plural depressed keys is set relatively small, while the correction for the after-touch data of the inside keys is set relatively large.

Since it is difficult to perform the after-touch operation on the inside keys as compared to the outside keys, the irregularity due to the slow variation of the after-touch data AFTi must have been occurred However, by use of the correction curves shown in FIG. 7, such irregularity can be corrected with ease.

(b) The key-on event processing procedure in the main routine RTO shown in FIG. 4 in the first embodiment includes the step SP6 wherein the key code data KCl to KC4 assigned to the tone-generation channel are re-arranged. Instead, it is possible to include such step SP6 in the after-touch processing program RTl shown in FIG. 5. In this case, the same effect of the first embodiment can be obtained.

(c) In the first embodiment, the sensitivity of touch data is corrected with respect to the after-touch effect. However, it is possible to modify the first embodiment so that such sensitivity can be corrected with respect to the initial-touch effect.

(d) The first embodiment uses the correction curves as shown in FIGS. 6 and 7 as the after-touch sensitivity correcting table data. However, the first embodiment is not restrictive. Hence, it is possible to provide other correction data by which the irregularity among the fingers can be corrected, in the case where the touch response effect is obtained by simultaneously depressing plural keys.

(e) The first embodiment uses the table data in order to correct the touch sensitivity. Instead, several kinds of correcting means can be applied to this embodiment. More specifically, it is possible to calculate the data along the correction curves by use of the arithmetic expression. Or, it is possible to provide the hardware exclusively used for the correcting means.

(f) The first embodiment corrects the touch information to thereby raise the touch response sensitivity in the lower tone pitch portion in the complex-tone performance played by the player's left hand. Instead, in the case where the complextone performance is played by the player's right hand, it is possible to correct the touch data to thereby raise the touch response sensitivity in the higher tone pitch portion.

(g) The first embodiment corrects the sensitivities of touch response information of all of the depressed keys. Instead, it is possible to correct the touch response information such that the sensitivities of touch response information of the keys having lower tone pitches can be raised while those of the keys having higher tone pitches can be lowered. In addition, the touch response information of other keys is used as it is.

[B] SECOND EMBODIMENT

(1) DETAILED DESCRIPTION OF SECOND EMBODIMENT

Figure 8:
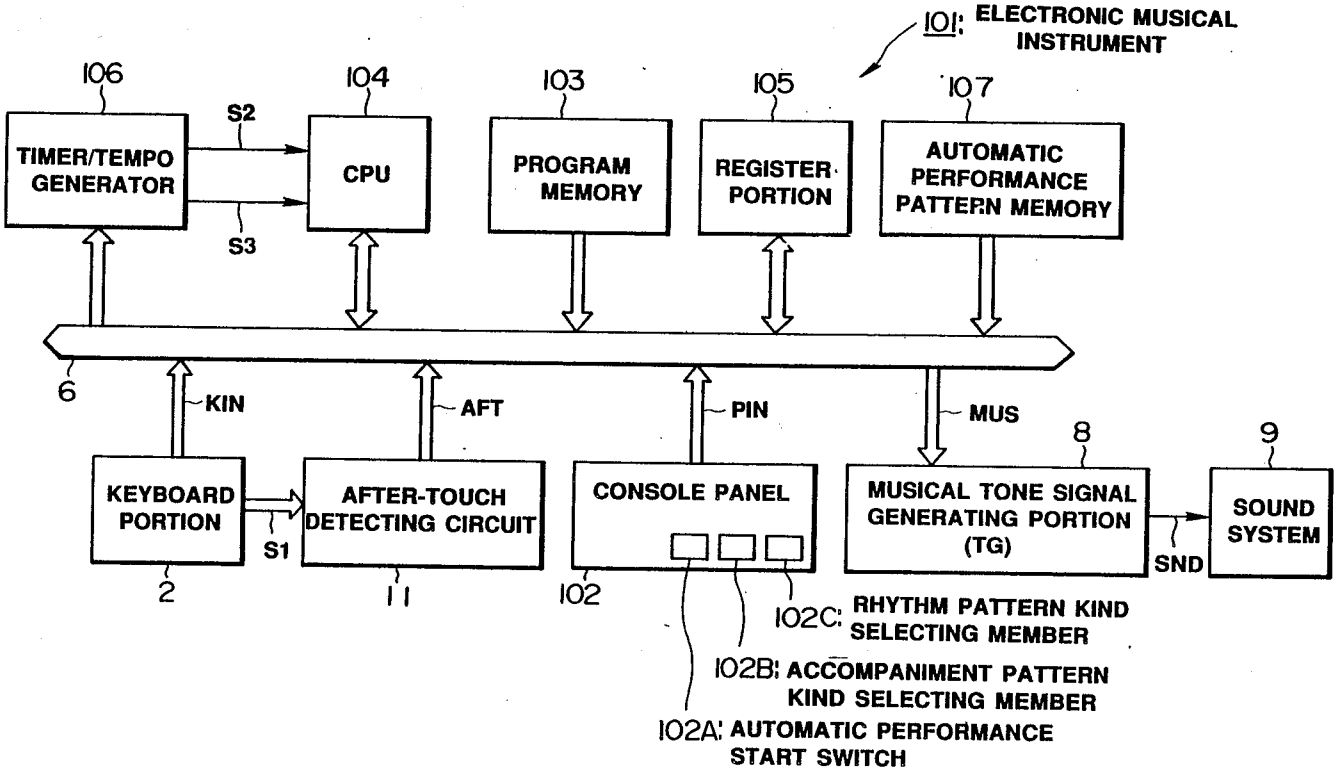
FIG. 8 is a block diagram showing an electronic musical instrument according to a second embodiment.
Figure 9:
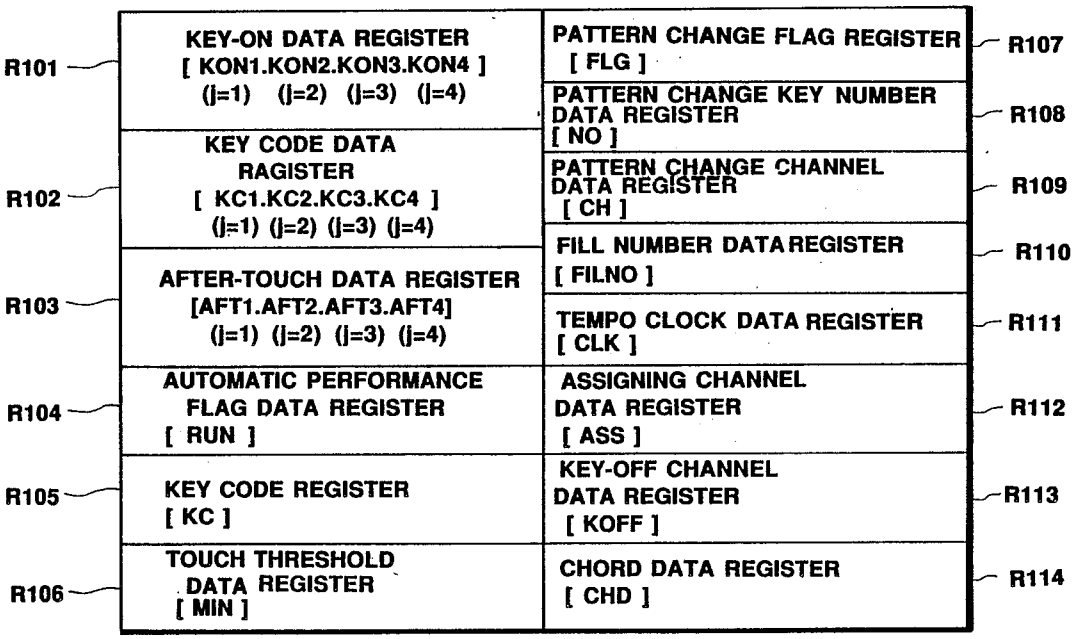
FIG. 9 is a diagrammatical diagram showing a detailed constitution of a register portion of second embodiment shown in FIG. 8.

Next, description will be given with respect to the second embodiment of the present invention. In FIG. 8, parts identical to those in FIG. 1 will be designated by the same numerals, hence, description thereof will be omitted. In an electronic musical instrument 101 according to the second embodiment, a CPU 104 executes the programs stored in a program memory 103 to thereby execute main routine RTIO shown in FIG. 10, after-touch process RTll shown in FIG. 11 and tempo process RT12 shown in FIG. 12. Then, a register portion 105 (as shown in FIG. 9) stores the key information KIN and operable member information PIN described before.

In the second embodiment, when the plural keys are simultaneously depressed, the data of each key are assigned to the tone-generation channel consisting of four time slots. Thus, the second embodiment executes the musical tone signal generating process of each data based on time division system by the timing of corresponding time slot.

As described above, the musical tone signal control information MUS is generated, and the CPU 104 supplies such information MUS to the musical tone signal generating portion 8 via the bus 6. Therefore, the musical tone signal generating portion 8 supplies the musical tone signal SND to the sound system 9, from which the plural musical tones corresponding to the depressed keys are generated.

When a timer/tempo generator 106 respectively supplies an after-touch interrupt signal S2 and tempo interrupt signal S3 to the CPU 104 by the predetermined time interval, the CPU 104 respectively executes the after-touch process RTII (shown in FIG. 11) and tempo process RT12 (shown in FIG. 12), so that the after-touch effect is applied to the musical tone or the musical tone according to the automatic performance pattern is generated.

In addition, when the timer/tempo generator 106 supplies the after-touch interrupt signal S2 and tempo interrupt signal S3 to the CPU 104 by the predetermined time interval, the CPU 104 respectively executes the after-touch process RTll (shown in FIG. 11) and tempo process RT12 (shown in FIG. 12), so that the after-touch effect is applied to the musical tone or the musical tone according to the automatic performance pattern is to be generated.

Figure 10:
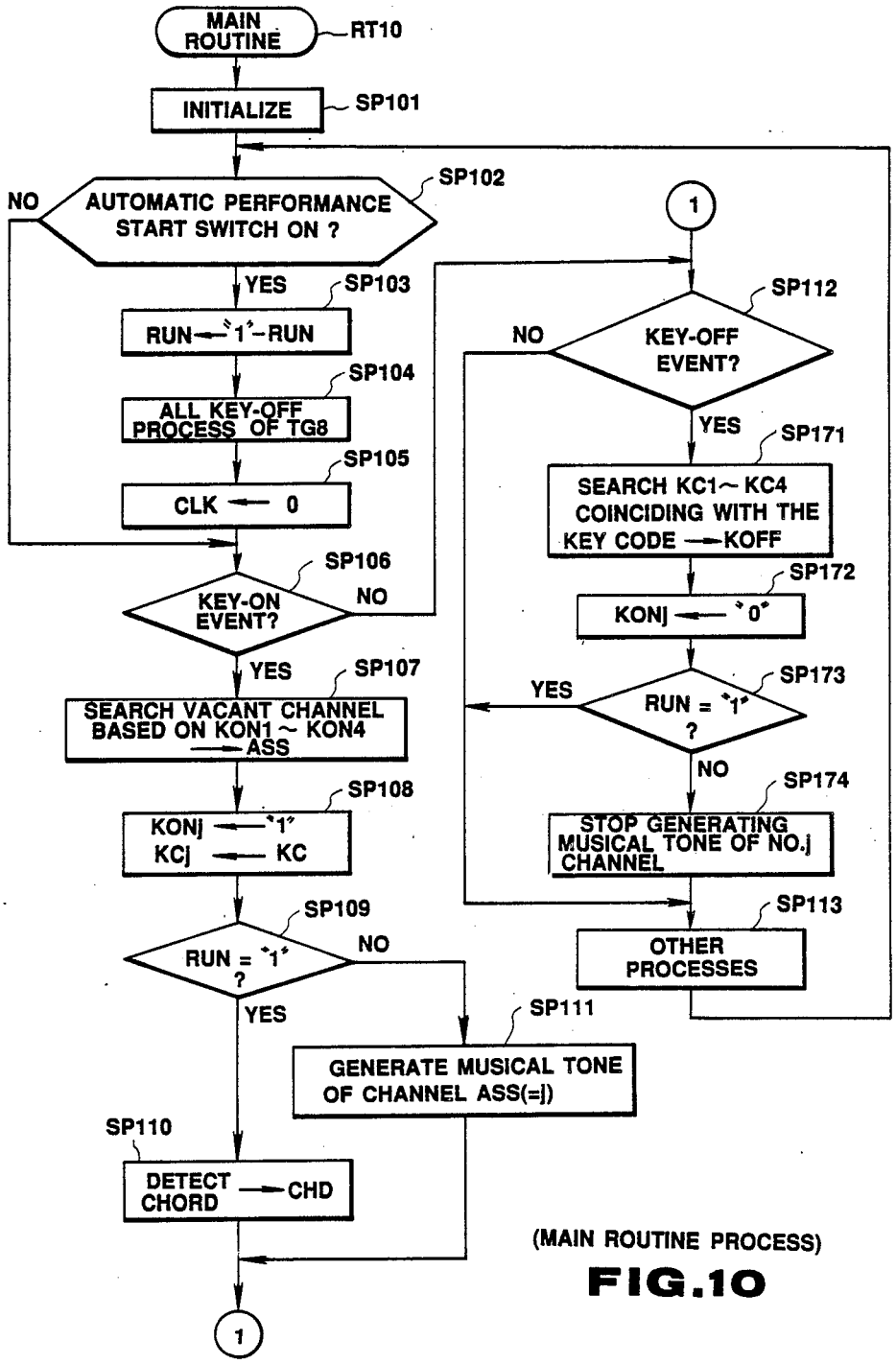
FIGS. 10, 11 and 12 are flowcharts respectively showing main routine, after-touch process and tempo process of second embodiment.

In FIG. 10, in the state where the electronic musical instrument 101 is activated, the CPU 104 starts to execute the processes of main routine RTIO. In a first step SPlOl, the electronic musical instrument 101 as a whole is initialized. At this time, each register within the register portion 105 is reset.

Next, the CPU 104 will execute an automatic performance start detecting process loop which consists of steps SPI02 to SP105. In this step SPI02, it is judged whether an automatic performance start switch 102A is operated or not. In other words, it is judged whether the key-on event is occurred or not. If the judgement result of this step SPI02 is "YES", the processing proceeds to a step SP103 wherein the following formula (1) is executed based on automatic performance flag data RUN stored in an automatic performance flag data register R104 (see FIG. 9).

$$\text{RUN} \leftarrow \text{"1"} - \text{RUN} \quad (1)$$

The automatic performance flag data RUN are the flag data of one bit. When the logical value of this data RUN is "1", it is designated that the player designates an automatic performance mode. Therefore, when the CPU 104 executes the above formula (1), the logical level of the data RUN is inverted, so that command information is stored into the register portion 105. Due to this command information, the automatic performance mode state is changed to non-automatic performance mode state or the non-automatic performance mode state is changed to automatic performance mode state by operating the automatic performance start switch 102A.

Until the next step SPI04, the musical tones are continuously generated based on the musical tone information held in the musical tone signal generating portion 8. However, in the step SPI04, the CPU 104 performs the key-off process such that the generation of musical tones is simultaneously stopped. Thereafter, the processing proceeds to a step SP105.

Figure 13:
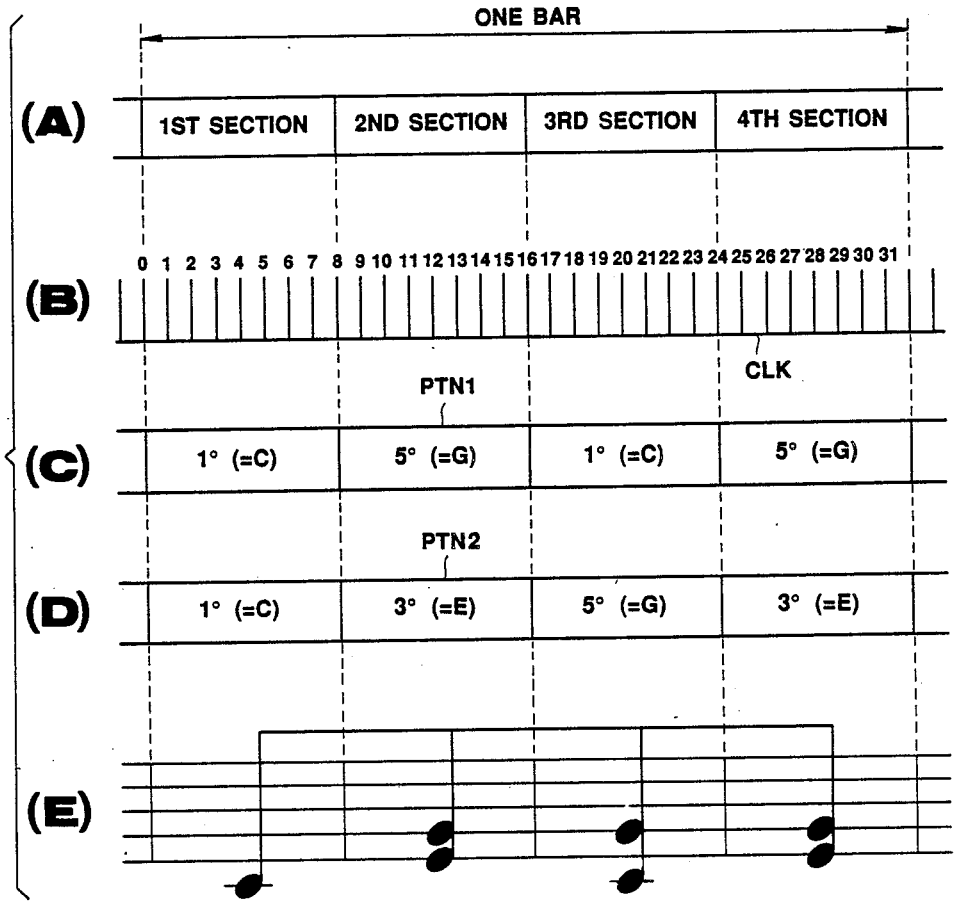
FIG. 13 is a diagrammatical diagram for explaining an automatic performance pattern of second embodiment.

Within the register portion 105, tempo clock data CLK are written into a tempo clock data register Rlll. In the step SPI05, the value of this tempo clock data CLK is reset to "0". In this case, one bar is divided by thirty-two clock pulses, i.e., No.1 to No.31 clock pulses as shown in FIG. 13(B). The tempo clock data CLK represent the clock pulse number which changes from "0" to "31". Such tempo clock data CLK are written into the tempo clock data register Rlll and then renewed. Thus, each time position of thirty-two clock pulses within one bar is designated by the tempo clock data CLK.

In the second embodiment, as shown in FIG. 13(A), the tempo clock data CLK "0", "8", "16" and "24" respectively indicate first section, second section, third section and fourth section.

As described above, the CPU 104 writes data CLK="0" into the register Rlll as the tempo clock data CLK in the step SP105, which means that the clock of automatic performance mode is reset in the state where the first section of one bar is started.

After the CPU 104 completes the automatic performance start detecting process loop, the processing proceeds to a key-on event process loop which starts from the next step SP106.

On the contrary, when the judgement result of step SPI02 is "NO" (which means that the player does not operate the automatic performance start switch 102A), the processing of CPU 104 jumps to the step SP106 without executing the processes in the step SP103 to SP105.

In the step SP106, it is judged whether the key-on event is occurred or not. If the judgement result of this step SP106 is "YES", the processing proceeds to a step SP107. At this time, each of the key-on data KONl to KON4 consist of the flag data of one bit written in a key-on data register R1O1. In the step SPI07, the CPU 104 searches the vacant channel based on such key-on data KONl to KON4, and then an assigning channel data register R112 stores the assigning channel data ASS representative of the tone-generation channel number which must be assigned to the searched vacant channel.

The above assigning channel data ASS will designate the No.j tone-generation channel. In the next step SP108, the key-on data KONj having the logical value "1" are written into the No.j tone-generation channel in the key-on data register RlOl, while the key code data KCj are written into the No.j tone-generation channel in a key code data register R102.

The above key-on data KONj having the logical value "1" represents that the key having the key code KCj is now depressed. Such key code data KCj and key-on data KONj are held in the register portion 105.

In the next step SP109, the CPU 104 judges whether the automatic performance flag data RUN written in the register R104 has the logical value "1" or not.

If the judgement result of this step SPlOg is "YES" (which means that the player designates the automatic performance mode), the processing proceeds to the next step SPllO wherein the CPU 104 writes chord data CHD into a chord data register Rl14. This chord data CHD represent the chord consisting of plural key codes whose keys are simultaneously depressed.

For example, as shown in FIG. 13(D), when the keys having tone names "C", "E" and "G" (i.e., "do", "mi" and "so" are depressed, the CPU 104 writes the chord data CHD representative of the major chord into the chord data register R114. Then, the proceeding proceeds to the next step SP112.

On the contrary, when the judgement result of the above step SPI09 is "NO" (which means that the player does not designate the automatic performance mode), the processing proceeds to the step SPIII wherein the corresponding key code data KCj stored in the register R102 are transferred to the musical tone signal generating portion 8 in the time slot corresponding to the No.j tone-generation channel of register R112 which stores the assigning channel data ASS. Thus, the sound system 9 generates the corresponding musical tones. Thereafter, the processing proceeds to the step SPI12.

As described above, the CPU 104 completes the key-on event process loop. In the automatic performance mode, the CPU 104 executes the storing operation of the chord data CHD without generating the musical tones of depressed keys. However, when the automatic performance mode is not designated, the musical tones of depressed keys are immediately generated. Then, the processing proceeds to the next step SP112.

In this step SPI12, it is judged whether the depressed key is released or not, i.e., whether the key-off event is occurred or not. If the judgement result of this step SP112 is "YES", the processing proceeds to the key-off event process loop.

On the other hand, when the judgment result of this step SP112 is "NO" (which means that there is no new key-off event), the processing proceeds to the step SP113 wherein the CPU 104 executes the other processes. Then, the processing returns to the step SP102. Thereafter, unless the automatic performance start switch is newly turned on, or unless new key-on event or key-off event is occurred, the CPU 104 repeatedly executes the loop consisting of the steps SPI02 to SPI13, wherein the tone generation is continued in response to the performance of player.

Figure 11:
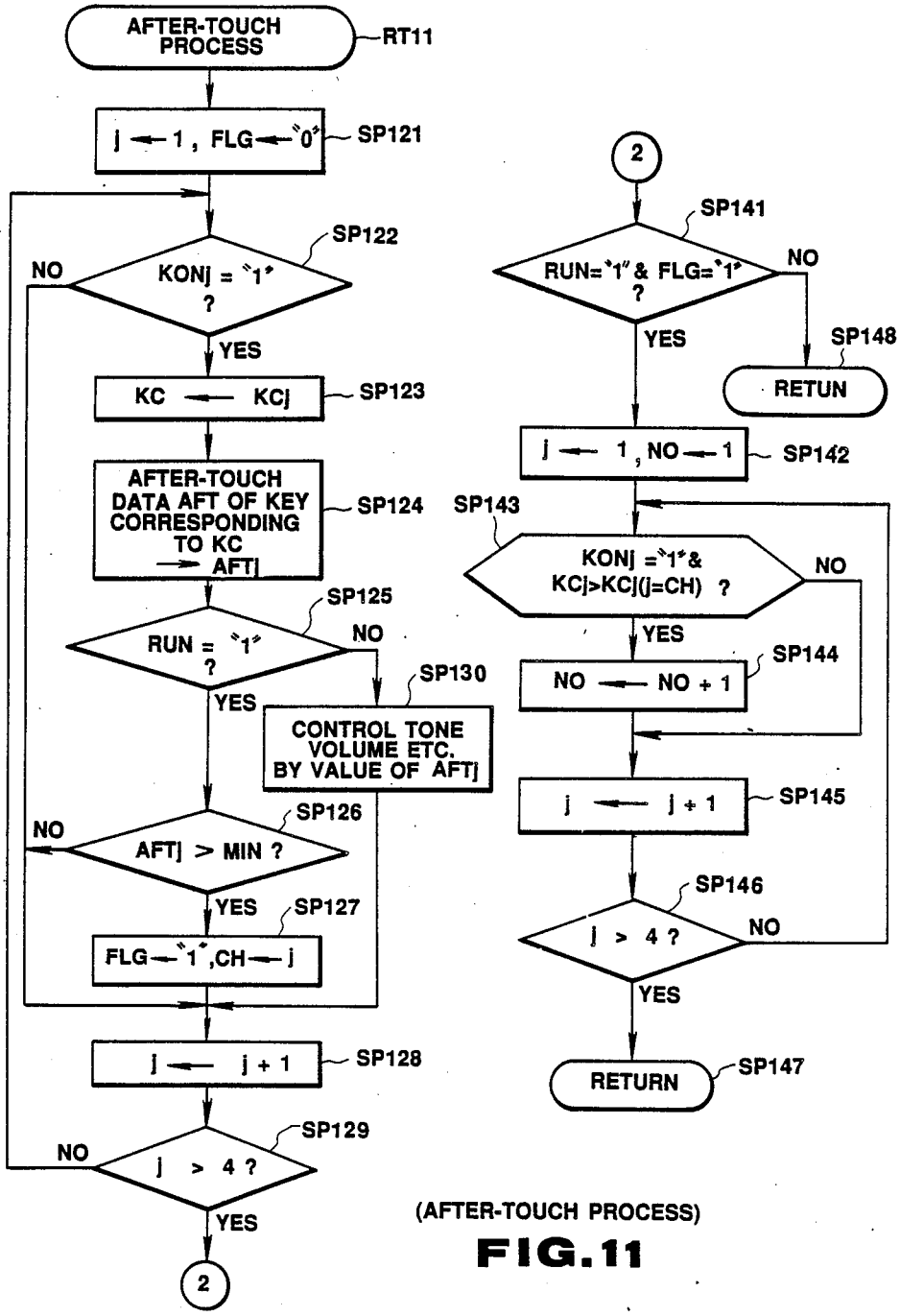
Figure 12:
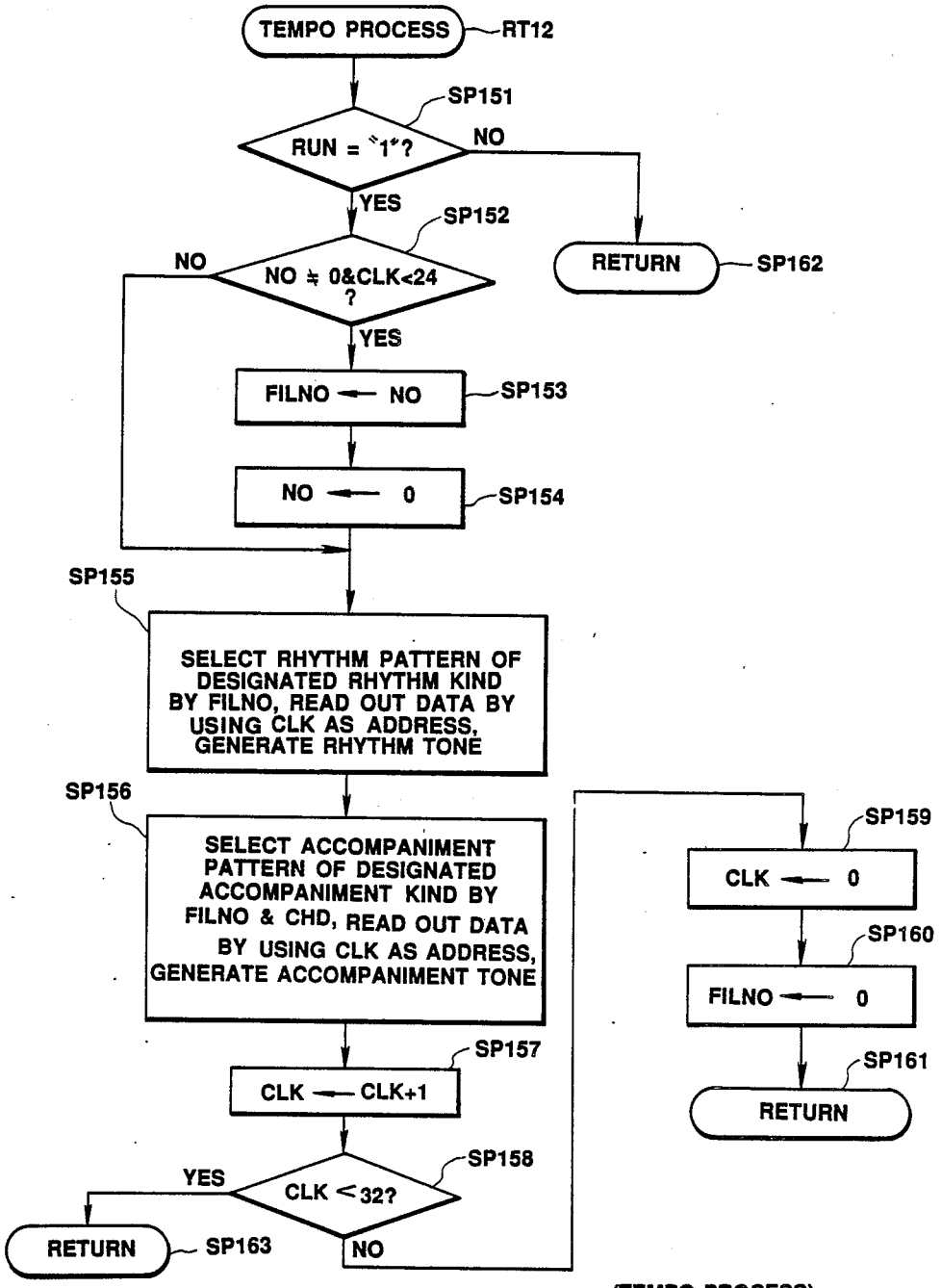

In such tone-generation state, when the timer/tempo generator 106 supplies the after-touch interrupt signal S2 (as the timer interrupt signal) to the CPU 104, the CPU 104 executes the after-touch process RTll as shown in FIG. 11.

First, the CPU 104 enters into an after-touch value evaluation processing loop which consists of steps SP121 to SP129. In the step SP121, the first tone-generation channel is designated by setting the tone-generation channel number j as j=1. In addition, the data having the logical value "0" are written into a pattern change flag data register R107 (see FIG. 9) as pattern change flag data FLG. Thus, the state of electronic musical instrument 101 is reset to the initial state.

Herein, the pattern change flag data FLG consist of the flag data of one bit. If such data FLG have the logical value "0", the automatic performance pattern is not changed. If the logical value of this data FLG is rewritten to "1", player designates that the automatic performance pattern should be changed.

Thereafter, the processing proceeds to a step SP122 wherein the CPU 104 judges whether the first key-on data KONj (where j=1) have the logical value "1" or not.

If the judgement result of this step SP122 is "YES" (which means the depressed key is assigned to the first tone-generation channel), the processing proceeds to the next step SP123 wherein the key code data KCj (where j=1) written in the register RI02 is rewritten into the key code register RI05 as the key code KC. Then, the after-touch data AFT are obtained from the key corresponding to the above key code KC, and such after-touch data AFT are written into an after-touch register RI03 as the after-touch data AFTj (where j=1).

Next, in a step SP125, the CPU judges whether the automatic performance flag data RUN written in the register R104 has the logical value "1" or not. If the judgement result of this step SP125 is "YES" (which means that the automatic performance mode is designated), the processing proceeds to a step SP126.

In this case, the after-touch data AFTj (where j=1) in the first tone-generation channel represents the after-touch value (which indicates the depressing pressure given by the player), while touch threshold data MIN are written in a touch threshold data register RI06. In the step SP126, it is judged whether the after-touch value is larger than the value of touch threshold data MIN or not. If the judgement result of this step SP126 is "YES" (indicating the player depresses the first key (i.e., No.j=1 key) by the depressing pressure which is larger than the depressing pressure represented by the touch threshold data MIN so that the automatic performance pattern should be changed), the processing proceeds to a step SP127. In this step SP127, the logical value of pattern change flag data FLG written in the register R107 is rewritten to "1". In addition, the tone-generation channel number j=1 is written into a pattern change channel data register RI09 as pattern change channel data CH.

Thus, the after-touch value evaluation processing loop is completed with respect to the number j1. Then, the CPU 104 adds the value "1" to the tone-generation channel number j to thereby obtain the new tone-generation channel number j in a step SP128. Thereafter, the processing proceeds to the next step SP129 wherein the CPU 104 judges whether such new tone-generation channel number j is larger than the number "4" of channels whose tones are to be simultaneously generated or not.

Meanwhile, if the judgement result of the foregoing step SP125 within the after-touch value evaluation processing loop is "NO" (which means that the automatic performance mode is not designated), the processing proceeds to a step SP130 wherein the tone volume of musical tone signal generating portion 8 is controlled by the value of after-touch data AFTj (where j=1) held in the register R103 so that the musical tone is applied with the after-touch effect of after-touch value corresponding to the depressing pressure of player. Thereafter, the processing proceeds to the foregoing step SP128.

In addition, if the judgement result of the foregoing step SP122 is "NO" (which means that the presently depressing key is not assigned to the No. j=1 tone-generation channel), the processing jumps over the steps SP123 to SP127 and then the processing proceeds to the step SP128.

Further, when the judgement result of the foregoing step SP126 is "NO" (which means that the depressing pressure of player is smaller than the depressing pressure represented by the touch threshold data MIN), the CPU 104 judges that the player does not intend to change the automatic performance pattern. In this case, the step SP127 is jumped over, and then the processing proceeds to the step SP128.

As described above, when the processing is completed with respect to the number j=1, the tone-generation channel number j is changed as j=2. Therefore, the judgement result of step SP129 becomes "NO". Then, the processing returns to the foregoing step SP122, and the CPU 104 repeatedly executes the after-touch value evaluation processing loop which consists of the steps SP122 to SP129.

Similarly, until the judgement result of step SP129 turns to "YES", the CPU 104 repeatedly executes the after-touch value evaluation processing loop, so that the after-touch values in the first to fourth tone-generation channels will be evaluated. As a result, the CPU 104 searches for the number j of tone-generation channel in which its depressing pressure of player is larger than that of the touch threshold data MIN, and such number j is held in the register RlOg as the pattern change channel data CH. At the same time, the data having the logical value "1" are written as the pattern change flag data FLG of the register R107. Thus, the register portion 105 holds the information inputted by the player who intends to change the automatic performance pattern.

Next, the processing enters into an automatic performance pattern judgement processing loop which start from the step SP141.

In the step SP141, it is judged whether the automatic performance flag data RUN stored in the register R104 and pattern change flag data FLG stored in the register R107 both have the logical value "1" or not. When the player inputs the command for changing the automatic performance pattern by use of the depressed key after the automatic performance mode is designated by operating the automatic performance start switch 102A (see step SP127), the judgement result of the step SP141 turns to "YES".

At this time, the processing proceeds to the next step SP142 wherein the CPU 104 sets the value "1" as the tone-generation channel number j and pattern change key number data NO. Such data NO are then written into a pattern change key number data register RI08.

Then, the key code data KCj(j=CH) correspond to the tone-generation channel which is designated by pattern change channel data CH stored in a pattern change channel data register RI09. In a step SP143, the CPU 104 judges that the key-on data KONj (where j=1) have the logical value "1" and the key code data KCj(j=1) are larger than the key code data KCj(j=CH).

If the judgement result of this step SP143 is "YES", the tone pitch of the key corresponding to the key code data KCj(j=1) is higher than that of the key corresponding to the key code data kCj(j=CH). At this time, the processing proceeds to the next step SP144 wherein the value "1" is added to the pattern change number data NO, and then the processing proceeds to a step SP145. Thus, when the tone pitches of musical tone signal generating portion 8 in the time slot corresponding to the tone-generation channel number j in which the key-off event is occurred. Then, the processing returns to the foregoing step SP113.

More specifically, the CPU 104 designates the automatic performance mode by writing the automatic performance flag data RUN having the logical value "1" into the register R104 in the automatic performance start process loop (consisting of the steps SPI02 to SP105) of the main routine RTIO. In addition, in the key-on event process loop (consisting of the steps SP106 to SP111), at every time when the player performs the new key, the register portion 105 inputs the key-on data KONj and key code buffer data KCBUFj of the performed key, and the register portion 105 also inputs the chord data CHD used in the accompaniment pattern.

Therefore, in the automatic performance mode, when the key-on event is occurred, the musical tones are not immediately generated but the CPU 104 waits for the after-touch interrupt signal S2 and tempo interrupt signal S3 from the timer/tempo generator 106. Then, the CPU 104 executes the automatic performance in accordance with the accompaniment pattern and rhythm pattern designated by the after-touch operation of player.

More specifically, in the after-touch value evaluation processing loop (i.e., the steps SP121 to SP130) in the after-touch process RTll (shown in FIG. 11), the CPU 104 searches for the tone-generation channel number j (where j=1 to 4) whose key-on data KONj has the logical value "1" by the after-touch interrupt signal S2. Then, the register portion 105 inputs the after-touch data AFTj from the after-touch detecting circuit 11 with respect to the key of key code data KCj corresponding to the key-on data KONj having the logical value "1". When the after-touch value exceeds over the value of touch threshold data MIN, the CPU 104 judges that the player designates the automatic performance pattern by using the key having the key code data KCj. At this time, the register portion 105 inputs the pattern change flag data FLG and pattern change channel data CH representative of the designating contents.

In this case, the player uses the certain key in order to designate the pattern change in the automatic performance pattern judging process loop (i.e., the steps SP141 to SP146) of the after-touch process RTll. This certain key has certain number in the higher-tone-pitch order within the simultaneously depressed keys. This certain number is judged by comparing the key code data KCj (where j=CH) with the key code data KCj (where j=1 to 4) stored in the register R102.

As described above, the player depresses the key of key code data KCj by the depressing pressure stronger than that of touch threshold data MIN within the simultaneously performed keys, so that the automatic performance pattern corresponding to such key can be designated.

In such state, when the timer/tempo generator 106 outputs the tempo interrupt signal S3, the CPU 104 executes the tempo process RT12 (shown in FIG. 12) to thereby select the corresponding automatic performance pattern based on the pattern change key number data NO indicative of the key which is strongly depressed by the player.

More specifically, the fill number data register R110 inputs the pattern change key number data NO as the fill number data FILNO (in the step SP153). When the value of fill number data FILNO is equal to i (where i=0 to 4), No. i rhythm pattern is read from eh pattern memory area FILNOli so that the corresponding rhythm tones will be generated (in the step SP155). In addition, the accompaniment pattern data are read from the pattern memory area FILNOi (where i=0 to 4) of the accompaniment pattern memory 102A so that the corresponding accompaniment pattern will be generated (in the step SP156).

In this case, the tempo interrupt signal S3 is generated by the time interval which is obtained by dividing one bar period by thirty-two. Therefore, the CPU 104 sequentially increments the value of tempo clock data CLK between No. 0 tempo clock (which is generated at the head timing of first section) and No. 31 tempo clock (which is generated at the end timing of fourth section) (in the step SP157). By the predetermined timing, the sustained tone constituting the broken chords can be generated based on the pattern data read from the accompaniment pattern memory 102A, while the percussive tone constituting the rhythm pattern can be generated based on the pattern data read from the rhythm pattern memory 102B.

In the case where the automatic performance pattern is to be changed over in such state, the player weakens the depressing pressure applied to the strongly depressed key but strengthens the depressing pressures applied to the other keys within the simultaneously performed keys.

Figure 14:
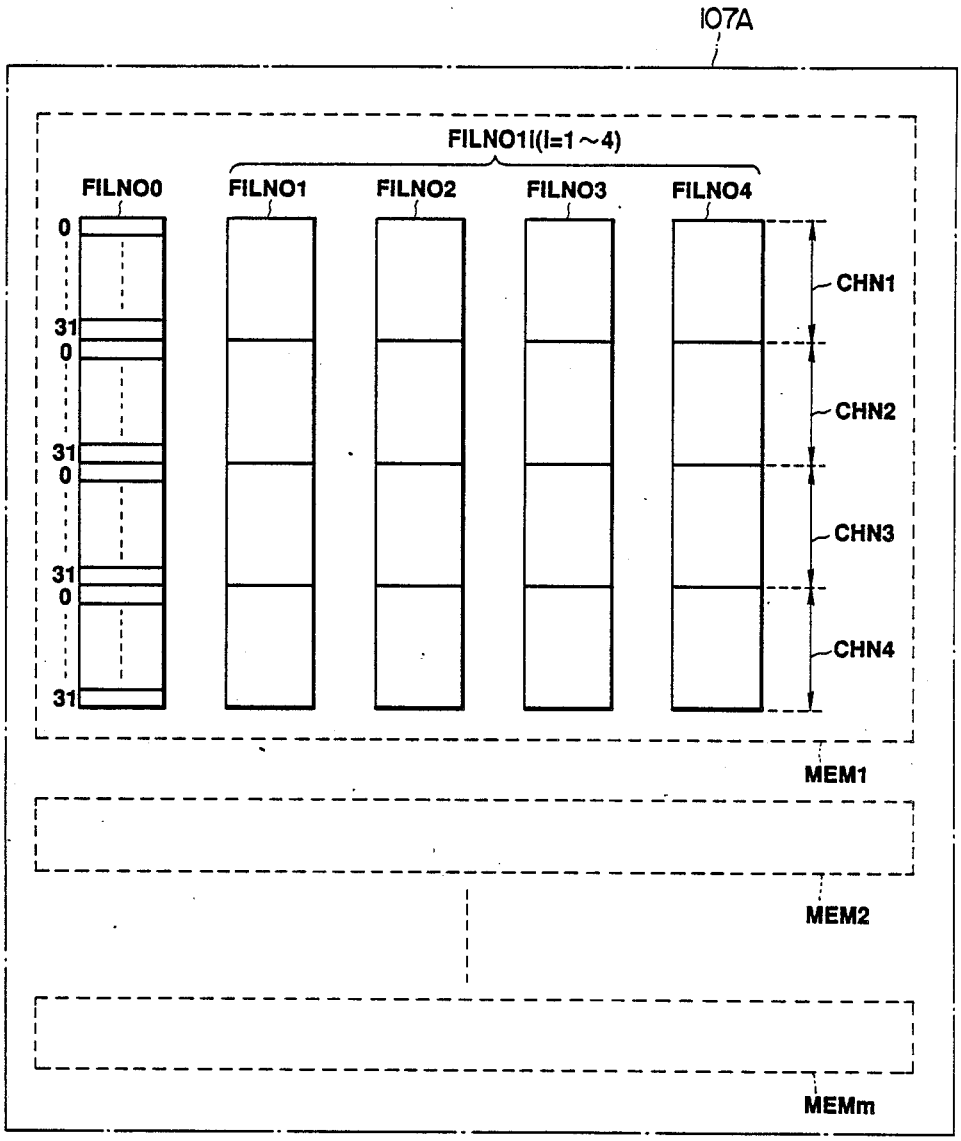
FIGS. 14 and 15 are diagrammatical diagrams respectively showing detailed constitutions of accompaniment pattern memory and rhythm pattern memory within an automatic performance pattern memory shown in FIG. 8.
Figure 15:
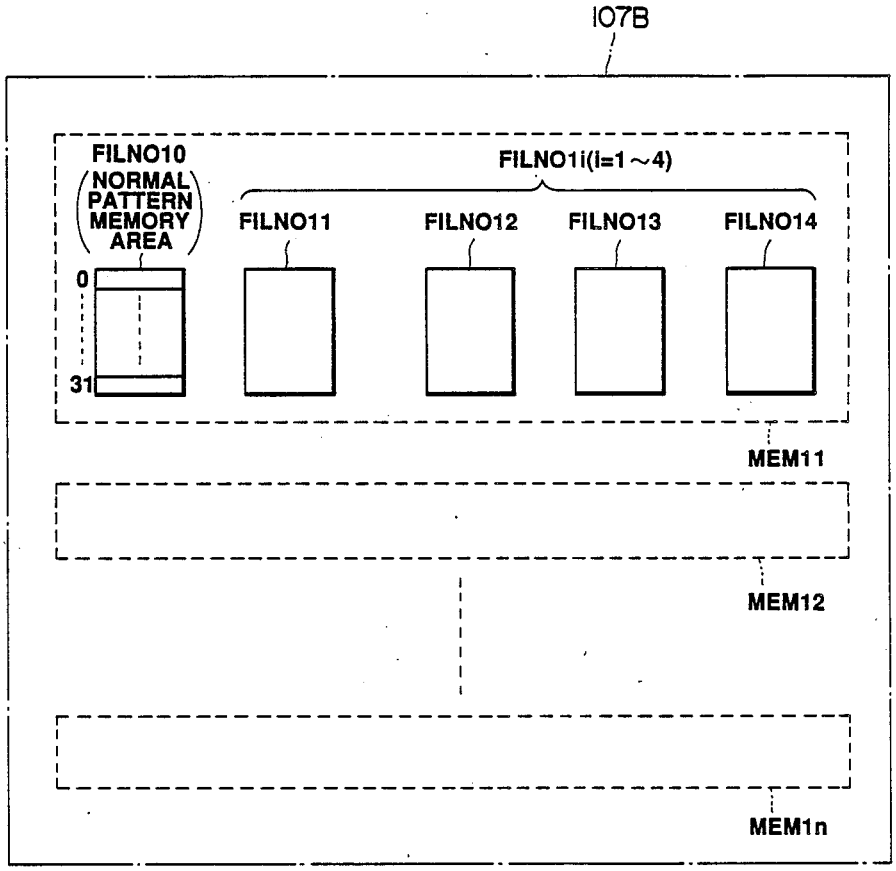

At this time, the CPU 104 inputs the tone-generation channel number j to which the changed key is assigned as the pattern change channel data CH (in the step SP127). Then, the order to such key in the higher-tone-pitch order is detected as the pattern change key number data NO (in the steps SP142 to SP146). In the tempo process RT12, based on the accompaniment pattern and rhythm pattern read from No. i pattern memory areas FILNOi (see FIG. 14) and FILNOli (see FIG. 15) indicated by the pattern change key number data NO which have been changed, the changed accompaniment tones and rhythm tones can be generated (in the steps SP156 and SP155).

In the case where the above automatic performance mode is changed to the normal performance mode, the player depresses the automatic performance start switch 102A.

In this case, the logical value of automatic performance flag data RUN is changed from "1" to "0" (in the step SP103), so that the CPU 104 can judge that the normal performance mode is designated. Then, when the new key-on event is occurred, the musical tone corresponding to the depressed key is to be generated. In addition, when the player executes the after-touch operation in the after-touch process RT11 (shown in FIG. 11), the after-touch effect having the corresponding after-touch value will be applied tot he musical tone (in the step SP130).

In the case where the player performs the electronic musical instrument 101 according to the second embodiment as described heretofore, the automatic performance pattern can be easily changed to the desirable pattern by merely strengthening the depressing pressure applied to no-key within the simultaneously depressed keys. Therefore, there is no need to exclusively provide the operable member for changing the automatic performance pattern which must be required for the conventional electronic musical instrument, so that it is possible to further simplify the performance operation of electronic musical instrument.

(2) MODIFIED EXAMPLES OF SECOND EMBODIMENT (a) In the second embodiment, one bar is limited to include four sections for performing the automatic performance patterns. However, it is possible to modify the second embodiment so that one bar can include more or less sections.

(b) The second embodiment is designed to change the automatic performance pattern by simultaneously performing plural keys in the accompaniment key area. However, the second embodiment can be applied to the keys in the melody key area.

(c) The second embodiment changes the automatic performance pattern by the after-touch operation. However, the automatic performance pattern can be changed by the initial-touch operation. In this case, the CPU judges the input operation of player based on the depressing speed and depressing depth of the key.

(d) The second embodiment sets one value as the touch threshold data MIN, and the CPU judges the changing operation of automatic performance pattern by whether the depressing pressure of the player exceeds over the depressing pressure indicated by the data MIN. However, it is possible to set plural threshold values so that the depressing pressure will be divided into several ranges by use of such plural threshold values. In this case, the input data of the player can be judged in response to which range the depressing pressure of player is belonged.

(e) In the case where the pattern change channel data CH are judged in the automatic performance pattern judging process loop (i.e., the steps SP141 to SP146) of the after-touch process RTll (shown in FIG. 11), such data CH are judged based on the order of depressed key in the higher-tone-pitch order. Instead, it is possible to judged the data CH based on the order of depressed key in the lower-tone-pitch order. In addition, it is also possible for the player to arbitrarily set such order of depressed key in the higher-tone-pitch or lower-tone-pitch order as well.

(f) The second embodiment changes the automatic performance rhythm pattern based on the inputted data by the touch operation of key. Instead, it is possible to employ the so-called preset type electronic musical instrument in which the data of console panel can be preset to the memory. In this case, the second embodiment can be applied for changing preset values or changing the designation of tone color according to needs. In short, the second embodiment can be widely applied to change "musical tone generating conditions" for specify the musical tones.

[C] THIRD EMBODIMENT

Next, description will be given with respect to the third embodiment of the present invention. Herein, parts identical to those in the first embodiment as shown in FIG. 1 will be designated by the same numerals, and description thereof will be omitted.

(1) DETAILED DESCRIPTION OF THIRD EMBODIMENT

Figure 16:
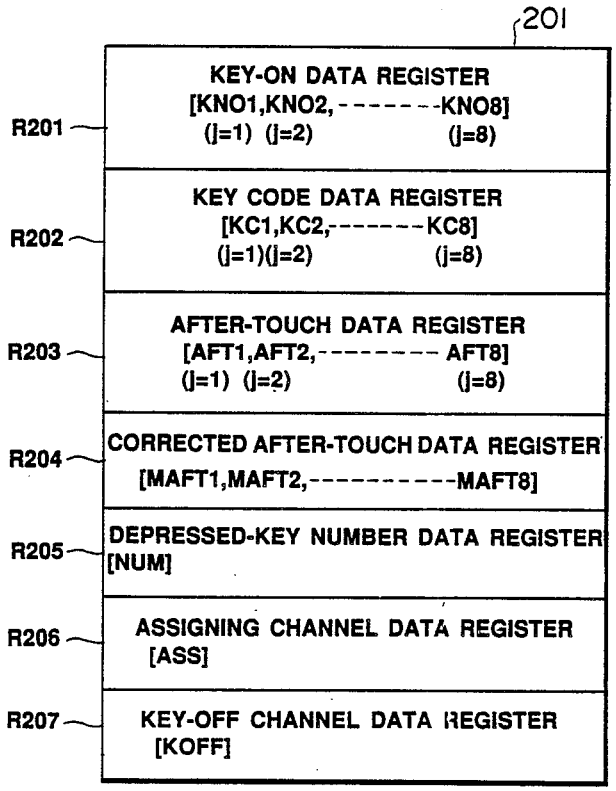
FIG. 16 is a diagrammatical diagram showing a detailed constitution of a register portion of third embodiment shown in FIG. 1.

The third embodiment is different from the first embodiment in the detailed constitution of a register portion 201 which includes key-on data register R201, key code data register R202, after-touch data register R203, corrected after-touch data register R204, depressed-key number data register R205, assigning channel data register R206 and key-off channel data register R207 as shown in FIG. 16.

In the third embodiment, the electronic musical instrument can simultaneously generate eight musical tones, for example. When the plural keys are simultaneously depressed, the data of each key is assigned to either one of eight tone-generation channels so that plural musical tones of depressed keys can be simultaneously generated.

Figure 17:
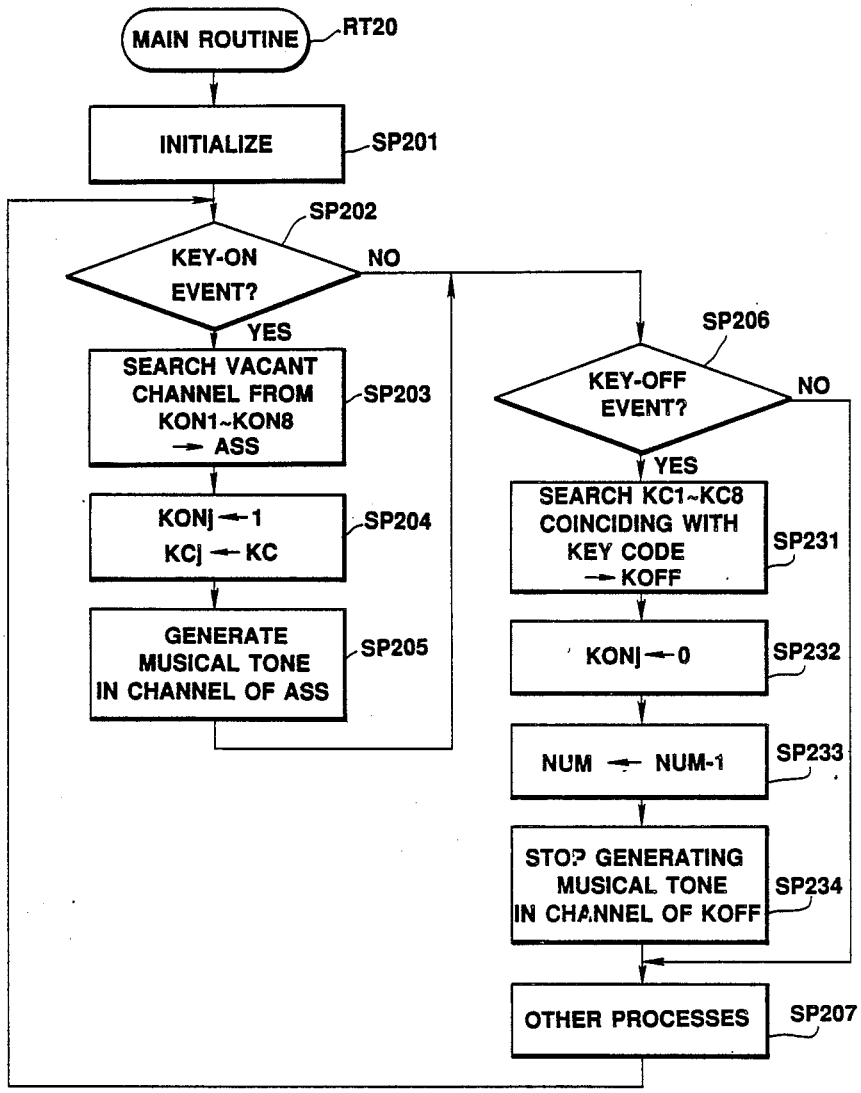
FIGS. 17 and 18 are flowcharts respectively showing main routine process and after-touch process of third embodiment.

The electronic musical instrument according to the third embodiment normally executes main routine process RT20 as shown in FIG. 17. In this main routine process RT20 shown in FIG. 17, steps SP201, SP202, SP203, SP204, SP205, SP206, SP207, SP231, SP232, SP233 and SP234 are identical or similar to the steps SP1, SP2, SP3, SP4, SP7, SP8, SP9, SP32, SP33, SP34 and SP36 in the main routine process RTO of first embodiment shown in FIG. 4. However, the third embodiment uses first to eighth tone-generation channels so that the channel number j varies from "1" to "8". In addition, the registers R201, R202, R203, R205, R206 and R207 of the third embodiment are similar to the registers REG1, REG2, REG3, REG5, REG6 and REG7. Therefore, description of main routine process RT20 of third embodiment will be omitted.

Figure 18:
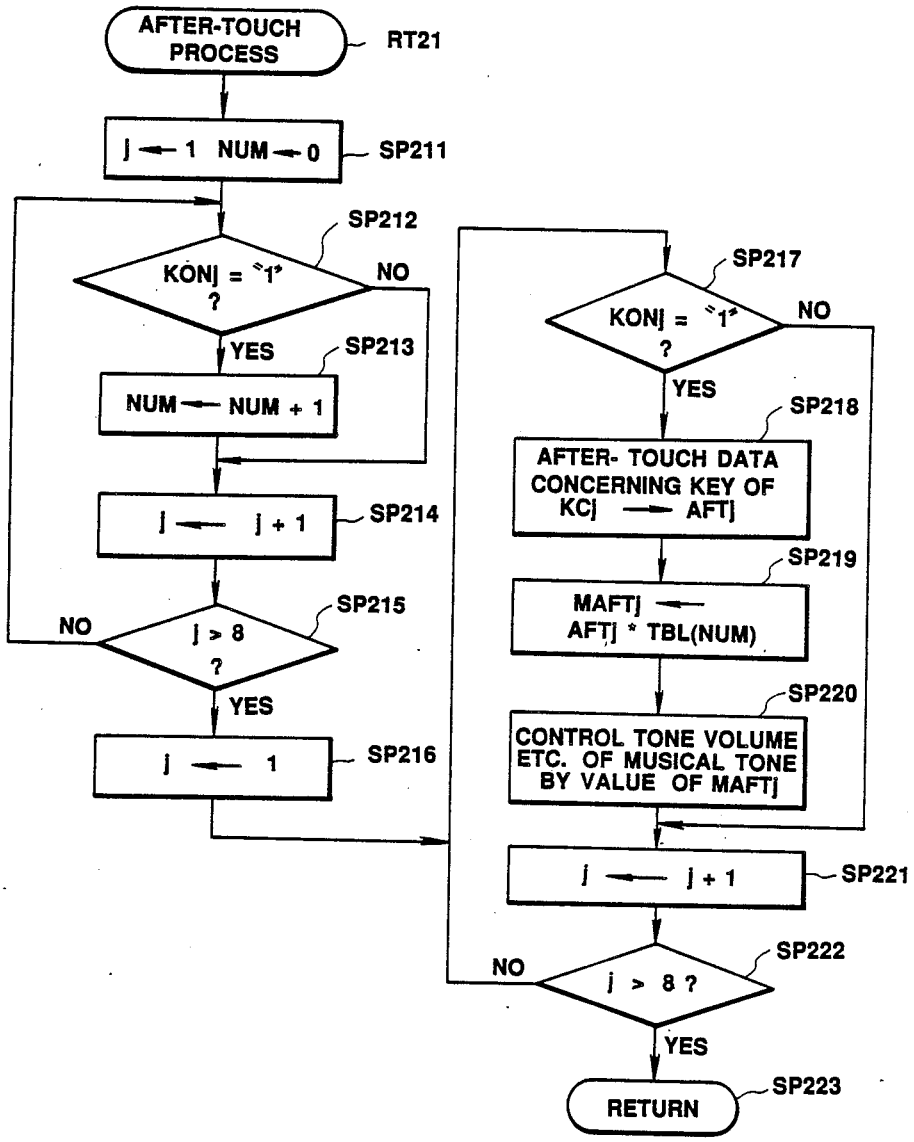

When the interrupt timer 12 supplies the interrupt signal S2 to the CPU5, the CPU5 starts to execute after-touch process RT21 as shown in FIG. 18.

More specifically, the processing enters into depressed key number counting process loop which start from a step SP211. In this step SP211, the tone-generation channel number j is set to the initial number j=1, and data NUM=0 are written as the depressed key number data NUM in the depressed-key number data register R205. Then, the processing proceeds to the next step SP212.

In this step SP212, the CPU 5 judges whether the logical value of key-on data KONj corresponding to the tone-generation channel number j (where j=1 at this timing) is equal to "1" or not. If the judgement result of this step SP212 is "YES" (which means that the musical tone of No. j channel is to be generated), the processing proceeds to a step SP213 wherein value "1" is added to the depressed key number data NUM in the register R205 so that No. j key is entered into the depressed key number data NUM.

Next, the processing proceeds to a step SP214 wherein the value "1" is added to the tone-generation channel number j so that No. (j+1) (where j+1=2) tone-generation channel is designated, then the processing proceeds to a step SP215.

In this step SP215, the CPU 5 judges whether the new tone-generation channel number j (which has been added with value "1" in the former step SP214) is larger than "8" or not. If the judgement result of this step SP215 is "NO" (which means that the depressed key number is not completely counted in all tone-generation channels), the processing returns to the foregoing step SP212 so that the processes of steps SP212 to SP215 are repeatedly executed with respect to the new tone-generation channel number j.

In this case, when the judgement result of the step SP212 turns to "NO" (which means that the key assigned to No. j tone-generation channel is not depressed), the processing jumps over the step SP213 and then directly proceeds to the step SP214.

Thereafter, when the judgement result of the step SP215 turns to "YES" (which means that the depressed key number is completely counted in all tone-generation channels), the processing proceeds to a step SP216 wherein the tone-generation channel number j is reset to "1" so that the processing will enter into the after-touch data process loop.

More specifically, the processing proceeds to a step SP217 wherein the CPU 5 judges whether the key-on data KONj assigned to No. j (where j=1) tone-generation channel has the logical value "1" or not. If the judgement result of this step SP217 is "YES" (which means that the key assigned to No.j channel is now depressing), the processing proceeds to the next step SP218 wherein the after-touch data of the key corresponding to the key code data KCj of tone-generation channel number j (where j=1) are stored in the after-touch data register R203 as the after-touch data AFTj of No.j tone-generation channel.

In such state, the CPU 5 will execute the after-touch sensitivity correcting process in the next step SP219.

Figure 21:
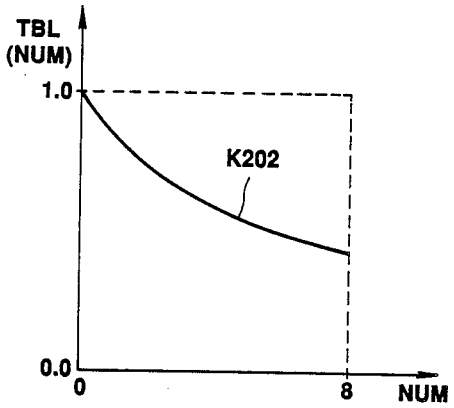
FIGS. 21 to 23 show graphs indicating curves of modified examples of third embodiment.
Figure 22:
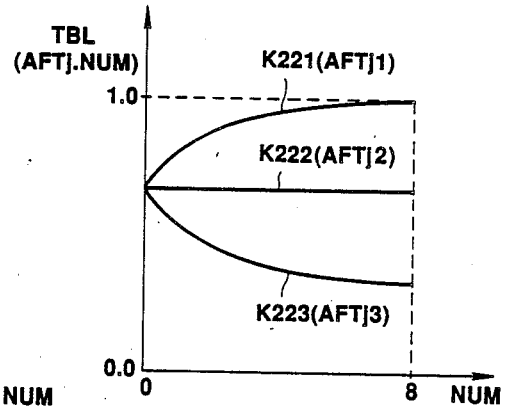

The third embodiment pays attention to that the depressing pressure of each finger tends to become weaker as the number of simultaneously depressing keys becomes larger. By correcting such phenomenon, the irregularity among the after-touch effects applied to the musical tones of depressed keys is prevented from being occurred. More specifically, the after-touch sensitivity correcting process is executed by use of after-touch sensitivity correcting table data TBL(NUM) (as shown in FIG. 21) which are pre-stored in the after-touch sensitivity correcting table memory 13 (shown in FIG. 1). Then, the corrected after-touch data MAFTj (where j=1) are written into the corrected after-touch data register R204 (shown in FIG. 16).

Next, the processing proceeds to a step SP220 wherein No.j corrected after-touch data MAFTj written in the register R204 are read out and then transferred to No.j tone-generation channel of the musical tone signal generating portion 8. Thus, based on the value of corrected after-touch data MAFTj, the tone volume, tone color etc. of the musical tone signal SND of No.j channel will be controlled.

As described above, the electronic musical instrument according to the third embodiment can generate the musical tone to which the after-touch effect is applied based on the corrected after-touch data MAFTj (where j=1) corrected by the depressed key number data NUM.

Thus, the CPU 5 completes the after-touch process with respect to the tone-generation channel indicated by the tone-generation channel number j (where j=1). In the next step SP221, the value "1" is added to the tone-generation channel number j, and then the processing proceeds to a step SP222 wherein the CPU 5 judges whether the tone-generation channel number j is larger than "8" or not. If the judgement result of this step SP222 is "NO" (which means that the after-touch correcting process is not completed in all tone-generation channels), the processing returns to the foregoing step SP217, whereby the after-touch correcting process in the steps SP217 to SP222 is repeatedly executed with respect to every tone-generation channel number j (where j varies from "2" to "8") until the judgement result of the step SP222 turns to "YES".

In the above-mentioned after-touch correcting process, when the judgement result of the step SP217 turns to "NO" (which means that the depressed key is not assigned to the tone-generation channel indicated by the number j), the processing jumps over the steps SP218 to SP220 and then the processing directly proceeds to the step SP221.

If the judgement result of the foregoing step SP222 turns to "YES" (which means that the after-touch correcting process is completed in all tone-generation channels), the processing returns to the main routine process via a step SP223.

Figure 19:
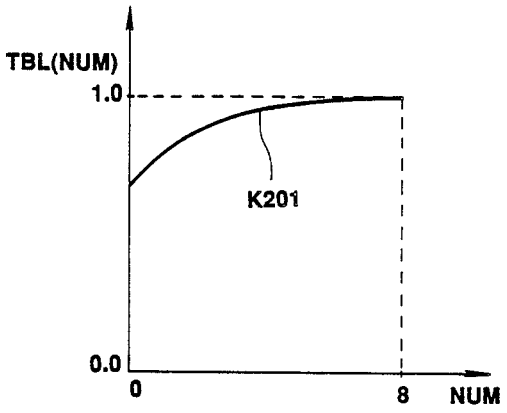
FIGS. 19 and 20 show graphs indicating curves of third embodiment for correcting after-touch effect.

The above-mentioned after-touch correcting process in the step SP219 is executed by use of the after-touch sensitivity correcting table data TBL(NUM) as shown in FIG. 19.

More specifically, the after-touch sensitivity correcting table memory 13 stores coefficient data as the after-touch sensitivity correcting table data TBL(NUM). The value of such coefficient data varies along a correction curve K201 whose value approaches to the constant value "1.0" as the value of depressed key number data NUM becomes larger. This after-touch sensitivity correcting table data TBL(NUM) are multiplied by the after-touch data AFTj which are outputted from the after-touch detecting circuit 11 and then written into the after-touch data register R203, and the product is corrected after-touch data MAFTj.

Figure 20:
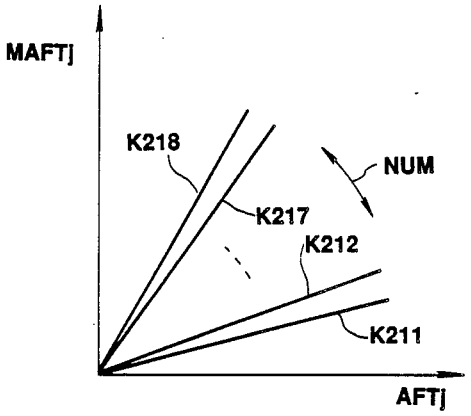

As the result of above multiplication, when the value of depressed key number data NUM is relatively small, the value of after-touch sensitivity correcting table data TBL(NUM) is set relatively small so that the change of corrected after-touch data MAFTj with respect to the change of after-touch data AFTj will be relatively small as shown by curves K211 and K212 in FIG. 20, which means that the after-touch sensitivity is low. On the contrary, as the value of depressed key number data NUM approaches to "8" which is equal to the number of tone-generation channels, the change of corrected after-touch data MAFTj with respect to the change of after-touch data AFTj becomes larger as shown by curves K217 and K218 in FIG. 20, which means that the after-touch sensitivity becomes higher.

In fact, as the number of simultaneously depressed keys becomes larger, the depressing pressure of each key becomes weaker so that the irregularity among the depressing pressures will be occurred. In this case, by automatically raising the after-touch sensitivities, the third embodiment can obtain the after-touch values which are diagrammatically identical to those in case of small number of simultaneously depressed key.

As described heretofore, when the interrupt timer 12 supplies the interrupt signal S2 to the CPU 5 under the state where the musical tones of depressed keys are generated by the sound system 9, the processing enters into the after-touch process RT21 (shown in FIG. 18). At first, in the depressed key number counting process loop (i.e., the steps SP211 to SP215), the number of presently depressed keys is counted. Thereafter, in the after-touch data process loop (i.e., the steps SP216 to SP222), the after-touch data AFTj inputted from the depressed keys are corrected by the after-touch sensitivity correcting table data TBL(NUM) which are read from the after-touch sensitivity correcting table memory 13 based on the depressed key number data NUM representative of the number of presently depressed keys (in the step SP219).

Thus, in the case where the number of simultaneously depressed keys becomes larger so that the depressing pressure of each key becomes weaker, the after-touch sensitivity is set higher. On the contrary, in the case where the number of simultaneously depressed keys becomes smaller, the after-touch sensitivity is set lower. As a result, even if the number of simultaneously depressed keys varies, the irregularity among the after-touch effects applied to the musical tones generated by the sound system 9 can be prevented from being occurred.

(2) MODIFIED EXAMPLES OF THIRD EMBODIMENT (a) The after-touch sensitivity correcting table data TBL(NUM) are not limited to the coefficient data whose value varies along the correction curve K201 as shown in FIG. 19.

For example, in the case where the player intends to apply the extremely large depressing pressures to partial keys within the simultaneously depressed keys, the depressing pressures of all depressed keys must become large so that the after-touch effects are afraid of becoming extremely large. In order to control the expansion of after-touch effect, it is possible to use the after-touch sensitivity correcting table data TBL(NUM) having the coefficient data whose value is lowered from the constant value "1.0" as the value of depressed key number data NUM becomes smaller as shown by a correcting curve K202 in FIG. 21.

(b) Instead of the single correcting curve K201 or K202, it is possible to provide plural correcting curves which are manually changed over by the operation of player.

(c) In the step SP219 shown in FIG. 18, the after-touch sensitivity correcting table data TBL(NUM) are obtained from the following formula (2).

$$MAFTj \leftarrow AFTj * TBL(NUM) \quad (2)$$

Instead, it is possible to use the following formula (3).

$$MAFTj \leftarrow AFTj * TBL(AFTj, NUM) \quad (3)$$

This formula (3) uses new after-touch sensitivity correcting table data TBL(AFTj, NUM) whose value varies in response to the depressed key number data NUM and after-touch data AFTj. In this case, plural correcting curves K221, K222 and K223 are provided with respect to the change of depressed key number data NUM, and different after-touch data AFTjl, AFTj2 and AFTj3 are assigned to these correcting curves K221, K222 and K223.

(d) In the third embodiment, the depressed key number counting process loop (i.e., the steps SP211 to SP215) is provided in the after-touch process RT21. In this case, the execution times of such loop must be small, hence, it is possible to obtain the effect in that the CPU 5 can execute the operation process efficiently.

On the contrary, it is possible to provide such loop in the main routine RT20. In this case, however, the above same effect can also be obtained.

(e) The third embodiment is designed to correct the sensitivity for the after-touch effect. Instead, it is possible to modify the third embodiment to correct the sensitivity of the initial-touch effect.

(f) The third embodiment uses the table data in order to correct the touch sensitivity. Instead, it is possible to calculate the correcting curve by use of an arithmetic operation. Or, it is also possible to exclusively provide the hardware for correcting the touch sensitivity.

Figure 23:
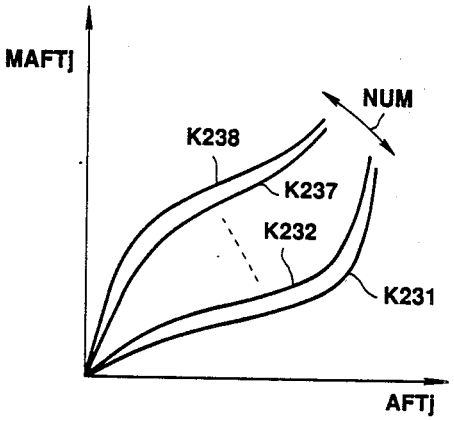
Figure 24:
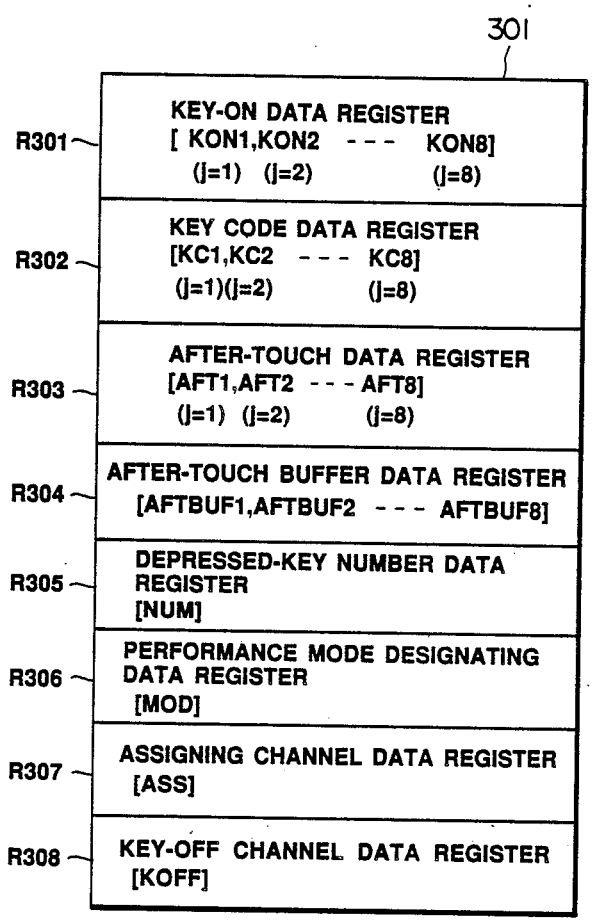
FIG. 24 is a diagrammatical diagram showing a detailed constitution of a register portion of fourth embodiment shown in FIG. 1.

(g) In order to obtain the corrected after-touch data MAFTj from the after-touch data AFTj, the third embodiment sets the correcting curves K211 to K218 linear as shown in FIG. 20. Instead, it is possible to select correcting curves K231 to K238 as shown in FIG. 23.

(h) In order to correct the touch data in response to the depressed key number, it is possible to use other information. For example, the touch data can be corrected to incorporate the difference between touch intervals of white key and black key depending on whether the depressed key is the white key or black key. Instead, it is possible to correct the touch data to incorporate the tone range of depressed key.

Further, it is possible to correct the touch data such that the touch range of the key having the highest tone pitch within the simultaneously depressed keys will be wider than the touch ranges of other keys. In this case, the musical tones are expressed such that the leading tone will be strengthened.

[D] FOURTH EMBODIMENT

Next, description will be given with respect to the fourth embodiment of the present invention. Herein, parts identical to those in the first embodiment shown in FIG. 1 will be designated by the same numerals, hence, description thereof will be omitted.

(1) DETAILED DESCRIPTION OF FOURTH EMBODIMENT

This fourth embodiment provides the monophonic tone performance mode capable of generating the musical tone in latter-first-method and the polyphonic tone performance mode capable of simultaneously generating eight musical tones, for example. In the polyphonic tone performance mode, the CPU 5 assigns the musical tone information to the eight tone-generation channels having eight time slots so that each musical tone information can be processed by the timing of corresponding time slot in the time division system. In the monophonic tone performance mode, the CPU 5 assigns the musical tone information to the time slot of first channel so that the musical tone information can be processed by the timing of first channel.

The CPU 5 generates the musical tone signal control information MUS as described above, and then such information MUS is supplied to the musical tone signal generating portion 8, from which the musical tone signal SND is outputted to the sound system 9. Thus, the musical tone of depressed key will be generated.

Meanwhile, the fourth embodiment is different from the first embodiment in the detailed constitution of a register portion 301 which includes key-on data register R301, key code data register R302, after-touch data register R303, after-touch buffer data register R304, depressed-key number data register R305, performance mode designating data register R306, assigning channel data register R307 and key-off channel data register R308. In addition, the fourth embodiment further provides a mode change switch 3A in the console panel 3.

Figure 25:
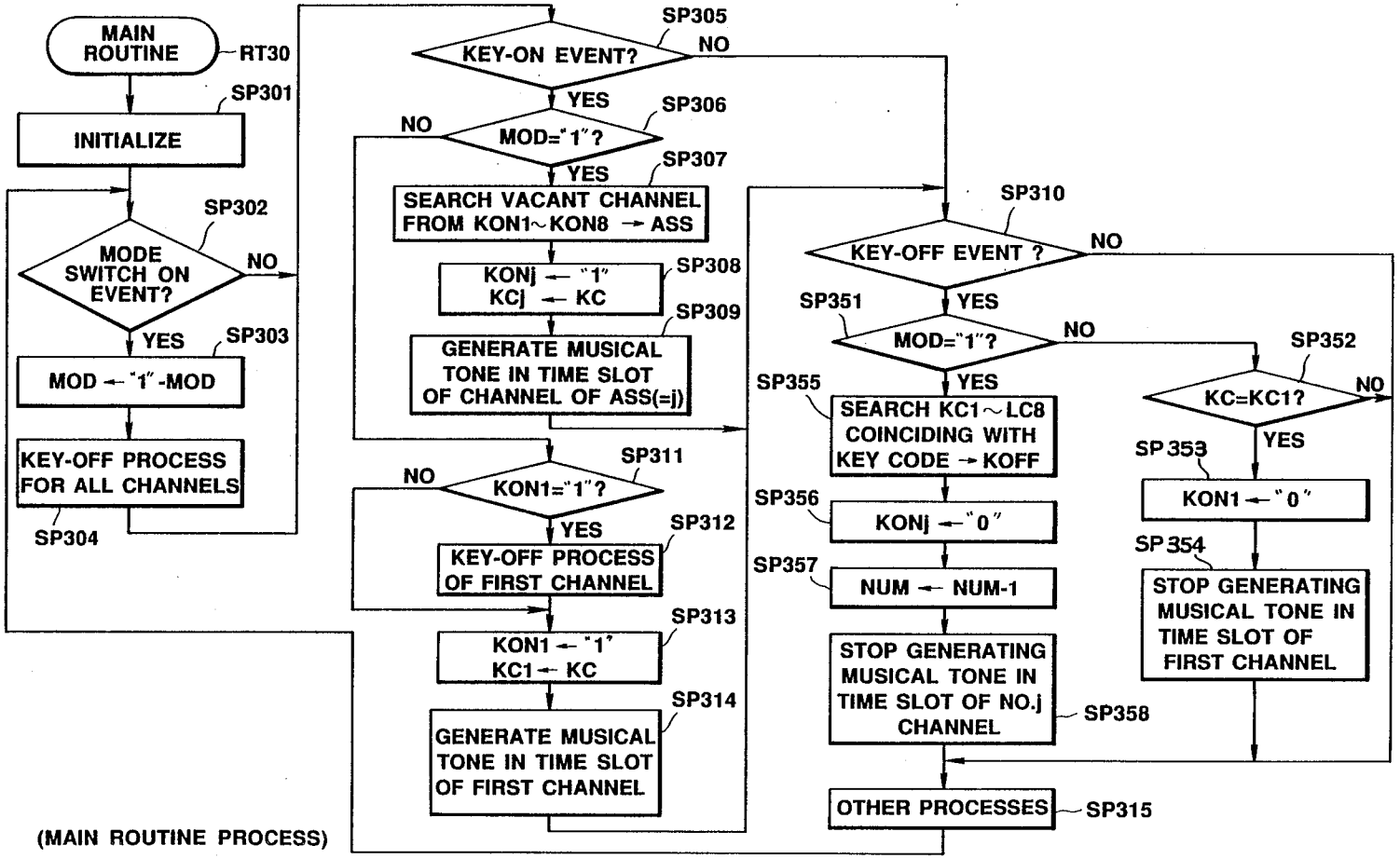
FIGS. 25 and 26 are flowcharts showing main routine process and after-touch process of fourth embodiment.

Next, description will be given with respect to main routine process RT30 of fourth embodiment shown in FIG. 25. In the first step SP301, the electronic musical instrument is initialized so that all registers in the register portion 301 are reset.

In the next step SP302, the CPU 5 judges whether the mode change switch 3A is operated or not. This mode change switch 3A is used for changing the present performance mode. When the judgement result of this step SP302 is "YES", performance mode designating data MOD representative of the newly designated performance mode are written into the register R306 in the register portion 301. This data MOD consist of flag data of one bit. Hence, the polyphonic tone performance mode is designated when the value of data MOD equals "1", while the monophonic tone performance mode is designated when the value of data MOD equals "0".

If the judgement result of the step SP302 is "YES", the processing proceeds to a step SP303 wherein the following operation (4) is executed.

$$MOD \leftarrow "1" - MOD \quad (4)$$

Thus, when the performance mode designating data MOD having the logical value "1" (which means that the polyphonic tone performance mode is designated) are held in the register R306 before the mode change switch 3A is depressed, the logical value of such data MOD is inverted to "0" (which means that the monophonic tone performance mode is designated). On the contrary, the performance mode designating data MOD of logical value "0" is previously held in the register R306, such logical value is inverted to "1".

Thereafter, the processing proceeds to a step SP304 wherein the key-off process is executed so that the generation of musical tones is stopped in all channels of the musical tone signal generating portion 8. Thus, the CPU 5 erases the whole musical tone information which has been held in the musical tone signal generating portion 8 in the preceding performance mode. Then, the processing proceeds to the next step SP305.

On the other hand, when the judgement result of the foregoing step SP302 is "NO" (which means that the performance mode is not changed), the processing directly jumps to the step SP305 without executing the processes of steps SP303 and SP304.

In the above-mentioned mode designation process loop consisting of the steps SP302, SP303 and SP304, the CPU 5 can always confirm the performance mode which is designated at present.

In the step SP305, it is judged whether any key is newly depressed or not. When the judgement result of this step SP305 is "NO", the processing proceeds to a step SP310.

On the contrary, when the judgement result of this step SP305 is "YES", the processing proceeds to a step SP306 wherein the CPU 5 judges whether the logical value of performance mode designating data MOD is "1" or not. If the judgement result of this step SP306 is "YES", the processing proceeds to the next step SP307.

The steps SP307, SP308 and SP309 are similar to the steps SP3, SP4 and SP7 of the main routine process shown in FIG. 4, hence, description thereof will be omitted. In short, the steps SP306 to SP309 constitutes the key-on event process loop of polyphonic tone performance mode wherein the musical tone of depressed key is generated by the timing of time slot of the channel whose number j is indicated by the assigning channel data ASS.

On the other hand, when the judgement result of the step SP306 is "NO" (which means that the monophonic tone performance mode is designated), the processing proceeds to a step SP311 wherein the key-on data KONl assigned to the first channel has the logical value "1" or not. If the judgement result of this step SP311 is "YES" (which means that the player depresses any key in the monophonic tone performance mode), the processing proceeds to the next step SP312 wherein one musical tone is selected in the latter-first-method and the selected musical tone is assigned to the time slot of first channel. Thus, the CPU 5 controls the musical tone signal generating portion 8 to execute the key-off process of first channel, and then the processing proceeds to a step SP313.

On the contrary, when the judgement result of the step SP311 is "NO", the processing jumps over the step SP312 and then directly proceeds to the step SP313. In this step SP313, the key-on data KONl having the logical value "1" is written in the first channel of register R301, while the key code which has been selected in the latter-first-method is written into the first channel of register R302 as the key code data KCl. Thus, it can be confirmed that the key corresponding to the key code data KCl is depressed during the logical value of key-on data KONI is at "1".

Thereafter, the processing proceeds to the next step SP314 wherein the musical tone having the tone pitch corresponding to the key code data KCl is generated by the timing of first channel in the musical tone signal generating portion 8. Then, the processing proceeds to the step SP310.

In the step SP310, it is judged whether the depressed key is newly released or not, i.e., whether the new key-off event is occurred or not. If the judgement result of this step SP310 is "NO", the processing proceeds to a step SP315 wherein the other processes are executed, and then the processing returns to the foregoing step SP302. Thereafter, if the mode change switch 3A is not operated and new key-on event and key-off event are not occurred, the CPU 5 continuously executes the processes of the loop consisting of the steps SP302, SP305, SP310 and SP315 to that the generation of musical tones is continuously executed.

Figure 26:
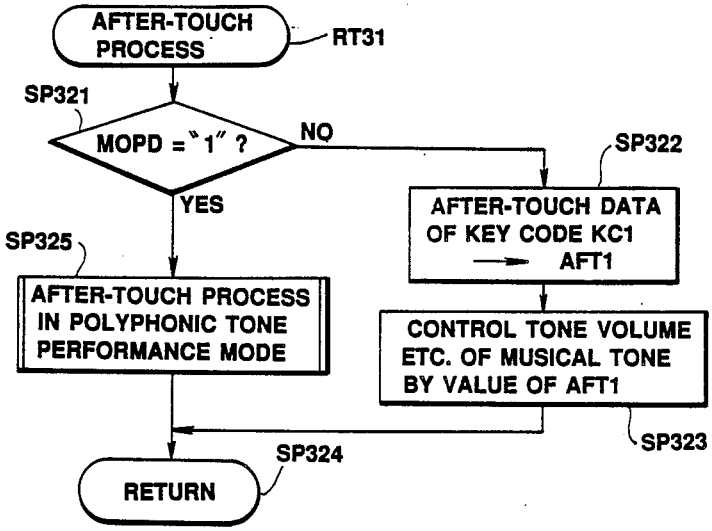

Meanwhile, in the musical tone generating state, when the interrupt timer 12 supplies the interrupt signal S2 to the CPU 5, the CPU 5 starts to execute after-touch process RT31 shown in FIG. 26. In the first step SP321, the CPU 5 judges whether the performance mode designating data MOD stored in the register R306 has the logical value "1" or not. If the judgement result of this step SP321 is "NO" (which means that the monophonic tone performance mode is designated), the processing proceeds to a step SP322 wherein the after-touch data of the key to which the key code data KCI of first channel is assigned are written in the register R303 as the after-touch data AFTl of first channel.

In the next step SP323, the CPU 5 controls the tone volume etc. of the musical tone which is generated in the time slot of first channel in the musical tone signal generating portion 8 based on the after-touch data AFTl.

Thus, in the after-touch process loop of monophonic tone performance mode consisting of the step SP322 and SP323, the musical tone is applied with the after-touch effect based on the after-touch data AFT which are obtained from the after-touch detecting circuit 11. Thereafter, the processing returns to the main routine process via a step SP324.

Figure 27:
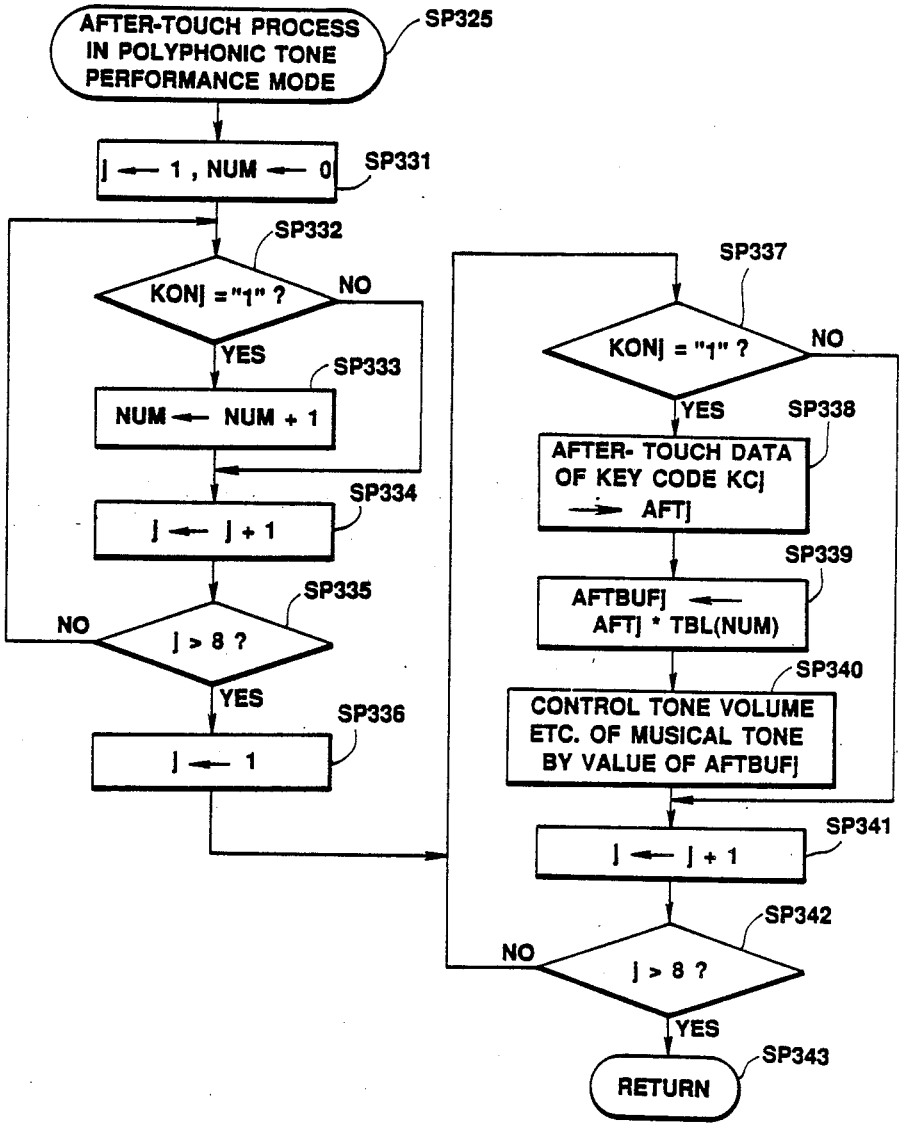
FIG. 27 is a flowchart showing detailed after-touch process in complex tone performance mode.

On the other hand, when the judgement result of the step SP321 is "YES" (which means that the polyphonic tone performance mode is designated), the processing proceeds to a step SP325, whereby the CPU 5 will execute after-touch process of polyphonic tone performance mode in accordance with a subroutine as show in FIG. 27.

More specifically, the processing enters into a depressed key number counting process loop which start from a step SP331 wherein the tone-generation channel number j is set as j=1 and the value "0" is written in the register R305 as the depressed key number data NUM.

In the next step SP332, the CPU 5 judges whether the key-on data KONj of tone-generation channel number j (where j=1 at this timing) stored in the register R301 has the logical value "1" or not. If the judgement result of this step SP332 is "YES", the processing proceeds to a step SP333 wherein the CPU 5 adds the value "1" to the depressed key number data NUM stored in the register R305 to thereby the No.j key is entered into the depressed key number data NUM.

Then, the processing proceeds to a step SP334 wherein the CPU 5 adds the value "1" to the tone-generation channel number j to thereby designate No.(j+1) tone-generation channel number (where j+1=2 at this timing).

In the next step SP335, the CPU 5 judges whether the new tone-generation channel number j is larger than the tone-generation channel number "8" or not. If the judgement result of this step SP335 is "NO" (which means that the counting operation of depressed key number has not been completed in all tone-generation channel number), the processing returns to the foregoing step SP332, whereby the processes in the loop consisting of the steps SP332 to SP335 are repeatedly executed with respect to the new tone-generation channel number j so that the number of depressed keys assigned to the new tone-generation channel number j is counted.

On the contrary, when the judgement result of the step SP332 is "NO" (which means that the depressed key is not assigned to the No.j tone-generation channel), the processing jumps over the step SP333 and then directly proceeds to the step SP334.

Then, when the judgement result of the step SP335 turns to "YES", the processing proceeds to a step SP336 wherein the tone-generation channel number j is reset to "1" so that the processing enters into the after-touch process.

More specifically, the processing proceeds to a step SP337 wherein the CPU 5 judges whether the key-on data KONj assigned to No.j tone-generation channel (where j=1) have the logical value "1" or not. If the judgement result of this step SP337 is "YES" (which means that the key information of depressed key is assigned to the corresponding tone-generation channel), the processing proceeds to a step SP338 wherein the after-touch data corresponding to the key code data KCj are inputted into the register R303 as the after-touch data AFTj (where j=1).

In the above state, the processing proceeds to the next step SP339 wherein the CPU 5 executes the after-touch sensitivity correcting process.

Figure 28:
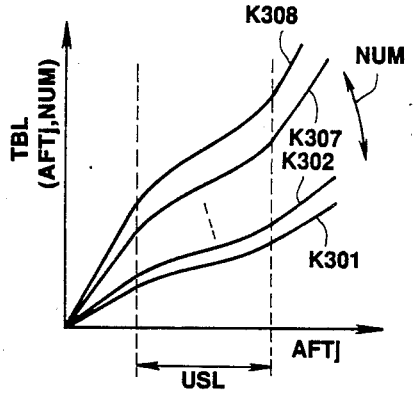
FIGS. 28 and 29 are graphs indicating curves for correcting after-touch sensitivity in the fourth embodiment.

In the step SP339, the after-touch data AFTj are corrected by use of the after-touch sensitivity correcting table data TBL(AFTj, NUM) as shown in FIG. 28, and the corrected after-touch data are written into the after-touch buffer data register R304 as after-touch buffer data AFTBUFj (where j=1).

Next, the processing proceeds to a step SP340 wherein the after-touch buffer data AFTBUFj are read from the register R304 and then transferred to the musical tone signal generating portion 8 wherein the tone volume and tone quality etc. of the musical tone signal SND are controlled in response to such data AFTBUFj.

Thus, the sound system 9 will generate the musical tone to which the after-touch effect is applied based on the after-touch buffer data AFTBUFj whose after-touch sensitivity is corrected by the depressed key number data NUM.

As described above, the CPU 5 completes the after-touch process with respect to the No.j tone-generation channel (where j=1). Then, the value "1" is added to the tone-generation channel number j in a step SP341. Thereafter, the processing proceeds to the next step SP342 wherein the CPU 5 judges whether the new tone-generation channel number j becomes larger than "8" or not. If the judgement result of this step SP342 is "NO" (which means that the after-touch sensitivity correcting process has not been completed in all tone-generation channels), the processing returns to the foregoing step SP337, whereby the after-touch sensitivity process loop consisting of the steps SP337 to SP342 is repeatedly executed with respect to all tone-generation channel numbers j (where j varies from "2" to "8") until the judgement result of the step SP342 turns to "YES".

During the above-mentioned process, when the judgement result of the step SP337 turns to "NO" (which means that the data of depressed key are not assigned to No.j tone-generation channel), the processing jumps over the steps SP338 to SP340 and then the processing directly proceeds to the step SP341.

Then, when the judgement result of the step SP342 turns to "YES" (which means that the after-touch sensitivity correcting process is completed in all tone-generation channels), the processing returns to the main routine process via a step SP343.

Next, detailed description will be given with respect to the after-touch sensitivity correcting process in the step SP339.

The after-touch sensitivity correcting table memory 13 (shown in FIG. 1) pre-stores the after-touch sensitivity correcting table data TBL(AFTj, NUM) whose values increase along correcting curves K301 to K308 as the value of depressed key number data NUM increases. In this case, the data of one correcting curve are selected by the depressed key number data NUM(=j) and the after-touch data AFTj are used as the address data so that the after-touch sensitivity correcting table data TBL(AFTj, NUM) will be read out. Based on the read data TBL(AFTj, NUM), the after-touch buffer data AFTBUFj can be obtained.

In the case where the value of after-touch data AFTj is included within the range USL corresponding to the range of normally used depressing pressure, the inclinations of correcting curves K301 to K308 are set relatively small as compared to the case where the value of after-touch data AFTj is excluded from the range USL. Thus, when the fingers of player's left hand simultaneously depress plural keys with the normal depressing pressure in order to perform the accompaniment, the changing rate of after-touch value (i.e., the after-touch sensitivity) can be reduced. As a result, the after-touch effects applied to the musical tones constituting the accompaniment tones can be controlled such that such after-touch effects will not be conspicuous.

Therefore, when the depressing pressure of each key becomes weaker as the number of simultaneously depressed keys becomes larger, the selected correcting curve is changed from the curves K301, K302, ... to the curves K307, K308, ..., so that the after-touch sensitivity can be automatically raised higher. After all, the after-touch effects are corrected such that the after-touch effects in case of large number of depressed keys will become similar to those in case of small number of depressed keys.

Next, when the new key-off event is occurred during the key-on event process loop and after-touch process loop are executed, the judgement result of the foregoing step SP310 turns to "YES" so that the CPU 5 starts to execute the key-off event process which starts from a step SP351.

In the step SP351, the CPU 5 judges whether the performance mode designating data MOD have the logical value "1" or not. If the judgement result of this step SP351 is "NO", the processing proceeds to a step SP352 wherein the CPU 5 judges whether the key code KC of the released key coincides with the key code data KCl stored in the register R302 or not.

If the judgement result of this step SP352 is "YES", the processing proceeds to a step SP353 wherein the value "0" is written as the key-on data KONl stored in the register R301. Then, in the next step SP354, the CPU 5 executes the key-off process so that the musical tone signal generating portion 8 will stop generating the musical tone in the time slot of first tone-generation channel. Thereafter, the processing returns to the foregoing step SP315.

On the contrary, when the judgement result of the step SP352 is "NO" (which means that the key code data of released key are not stored in the register R302 by the latter-first-process), the processing jumps to the step SP315 without executing the processes of step SP353 and SP354. Thus, the efficient of processing the main routine process program will be raised higher.

On the other hand, when the polyphonic tone performance mode is designated, the judgement result of the foregoing step SP351 turns to "YES" so that the processing proceeds to a step SP355. In FIG. 25, the steps SP355, SP356, SP357 and SP358 are similar to the steps SP32, SP33, SP34 and SP36 shown in FIG. 4, hence, description thereof will be omitted. Then, the key-off event process of polyphonic tone performance mode is completed, and the processing returns to the step SP315.

After all, the fourth embodiment can reduce the after-touch sensitivity in the polyphonic tone performance mode as compared to the monophonic tone performance mode. Hence, in the monophonic tone performance mode, vivid expression can be applied to the musical tone with high after-touch sensitivity. Further, in the polyphonic tone performance mode, natural after-touch effect can be applied to the musical tone.

(2) MODIFIED EXAMPLES OF FOURTH EMBODIMENT (a) Instead of providing the mode change switch 3A in the console panel 3, it is possible to divide one or plural keyboards into a key area of monophonic tone performance (e.g., the melody key area) and another key area of polyphonic tone performance (e.g., the accompaniment key area). In this case, the CPU 5 detects which key area is performed to thereby determine the performance mode.

(b) In the fourth embodiment, the different after-touch data are obtained by every depressed key. Instead, it is possible to apply one after-touch effect to all musical tones of depressed keys by use of the after-touch data which are obtained from the key to which the strongest depressing pressure is applied, for example.

(c) Instead of the after-touch effect, it is possible to modify the fourth embodiment to apply the initial-touch effect to the musical tone.

(d) The fourth embodiment corrects the after-touch data obtained in the polyphonic tone performance mode but does not correct the after-touch data obtained in the monophonic tone performance mode. However, it is possible to correct the after-touch data in the monophonic tone performance mode.

Figure 29:
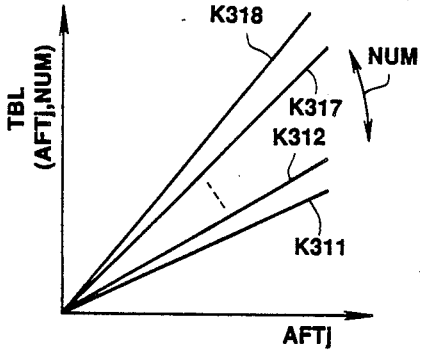

(e) In the fourth embodiment, the touch sensitivity is lowered in the range USL of correcting curves as shown in FIG. 28. Instead, it is possible to use correcting curves K311 to K318 whose values vary linearly as shown in FIG. 29.

Above is the whole description of preferred embodiments of the present invention. This invention may be practiced or embodied in still other ways without departing from the spirit or essential character thereof as described heretofore. Therefore, the preferred embodiments described herein are illustrative and not restrictive, the scope of the invention being indicated by the appended claims and all variations which come within the meaning of the claims are intended to be embraced therein.

We claim:

1. An electronic musical instrument comprising:

(a) plural keys each designating a different tone pitch;

(b) touch response information outputting means for detecting touch intensity of each of depressed keys to thereby output touch response information representing touch intensity for each key;

(c) musical tone generating means for generating musical tones corresponding to the depressed keys, each of said musical tones being controlled by said touch response information; and (d) correction means for correcting at least one of said touch response information as a function of tone pitch order representing one of ascending or descending pitch of simultaneously depressed keys.

2. An electronic musical instrument according to claim 1 wherein said touch response information is after-touch information corresponding to variation of depressing pressure of a key after said key is depressed.

3. An electronic musical instrument according to claim 2 wherein said correction means further comprises:

(a) a register in which plural key codes of simultaneously depressed keys are re-arranged in the tone pitch order; and (b) a correction table memory for pre-storing a correction table which stores at least one correction curve representative of relation between the actual after-touch information and corrected after-touch information, whereby each of said after-touch information of rearranged key codes is corrected with said correction curve such that irregularity among after-touch effects applied to he simultaneously depressed keys will be eliminated.

4. An electronic musical instrument comprising:

(a) a keyboard including plural keys each designating different tone pitch;

(b) a central processing unit coupled to the keyboard;

(c) a program memory coupled to the central processing unit for pre-storing programs representative of main routine process and after-touch process which are executed under control of said central processing unit;

(d) means for detecting depressing pressures of depressed keys, said depressing pressures being converted into after-touch information corresponding to variation of depressing pressure of a key after said key is depressed;

(e) a register for re-arranging key codes of plural keys which are simultaneously depressed in tone pitch order;

(f) a correction table memory for pre-storing a correction table which stores at least one correction curve representative of relation between actual after-touch information and corrected after-touch information, said after-touch information being corrected so that irregularity among after-touch effects applied to the simultaneously depressed keys due to irregularity among the depressing pressures of said keys each depressed by a different finger of player will be eliminated; and (g) musical tone generating means for generating musical tones to which corrected after-touch effects are applied.

5. An electronic musical instrument according to claim 4 wherein said correction curve stored within said correction table memory is predetermined in order to correct said after-touch effects in such a manner that said after-touch effects applied to keys toward a player's little finger of a particular hand will be stronger as compared to those applied to keys toward the player's thumb of the particular hand.

6. An electronic musical instrument according to claim 4 further comprises an interrupt timer for outputting an interrupt signal when said musical tones are to be generated, said interrupt signal activating said central processing unit to execute said after-touch process in connection with corrrection of after-touch effects by said correction table memory.

7. An electronic musical instrument capable of designating tone pitch and also performing touch response operation by depressing a key comprising:

detecting means for detecting touch response information which is obtained based on depressing pressure of key;

means for changing musical tone generating condition when value of said touch response information reaches at the predetermined level, wherein said musical tone generating condition is an automatic performance pattern and said touch response information is after-touch response information;

an automatic performance pattern memory for prestoring said automatic performance pattern, said automatic performance pattern including accompaniment pattern and rhythm pattern;

interrupt means for generating after-touch interrupt signal and tempo interrupt signal; and control means for respectively executing predetermined main routine process for generation the musical tone of depressed key, after-touch process for applying after-touch effect to the musical tone of depressed key and tempo process for generating said automatic performance pattern based on the depressing pressure of key, said after-touch process being started by said after-touch interrupt signal and said tempo process being started by said tempo interrupt signal.

8. An electronic musical instrument comprising:

(a) plural keys each designating different tone pitch;

(b) touch response information outputting means for detecting touch intensity of a depressed key to thereby output corresponding touch response information representative of the detected touch intensity for the key;

(c) musical tone generating means for generating a musical tone corresponding to the depressed key and controlled by said touch response information; and (d) correction means for detecting the number of simultaneously depressed keys, said correction means correcting said touch response information in response to the detected number of simultaneously depressed keys.

9. An electronic musical instrument according to claim 8 wherein said correction means corrects said touch response information with predetermined correction data whose value varies in response to number of simultaneously performed keys.

10. An electronic musical instrument comprising;

(a) selecting means for selecting either a monophonic tone performance mode capable of simultaneously designating only one tone pitch or a polyphonic tone performance mode capable of simultaneously designating plural tone pitches;

(b) means for applying a touch response effect to a muscial tone of a depressed key based on touch response information corresponding to depressing pressure of the depressed key; and (c) correction means for correcting sensitivity of touch response information such that sensitivity of touch response information in said polyphonic tone performance mode i lower than that in said monophonic tone performance mode, said touch response effect applied to the musical tone of depressed key being strengthened or weakened based on said sensitivity of touch response information.

* * * * *